US007563004B2

(12) United States Patent
Pickard et al.

(10) Patent No.: US 7,563,004 B2
(45) Date of Patent: Jul. 21, 2009

(54) VOLUMETRIC DOWNLIGHT LIGHT FIXTURE

(75) Inventors: Paul Kenneth Pickard, Conyers, GA (US); James Michael Lay, Cumming, GA (US); Doyle Scott Butler, Dunwoody, GA (US); Mark Campbell Logan, Atlanta, GA (US); Leslie Charles King, Loganville, GA (US)

(73) Assignee: Acuity Brands, Inc., Atlanta, GA (US)

( * ) Notice: Subject to any disclaimer, the term of this patent is extended or adjusted under 35 U.S.C. 154(b) by 65 days.

(21) Appl. No.: 11/653,781

(22) Filed: Jan. 16, 2007

(65) Prior Publication Data

US 2007/0177389 A1 Aug. 2, 2007

Related U.S. Application Data

(60) Provisional application No. 60/759,365, filed on Jan. 17, 2006.

(51) Int. Cl.
*F21V 5/02* (2006.01)
*F21V 5/04* (2006.01)

(52) U.S. Cl. ..... 362/309; 362/308; 362/329; 362/339

(58) Field of Classification Search ..... 362/147, 362/308, 309, 148–150, 326–340, 296, 307, 362/310, 311
See application file for complete search history.

(56) References Cited

U.S. PATENT DOCUMENTS

| | | | | | |
|---|---|---|---|---|---|
| 4,118,763 | A * | 10/1978 | Osteen | 362/339 |
| 4,450,509 | A * | 5/1984 | Henry | 362/216 |
| 4,791,540 | A * | 12/1988 | Dreyer et al. | 362/331 |
| 4,816,976 | A * | 3/1989 | Fouke et al. | 362/309 |
| 4,839,781 | A * | 6/1989 | Barnes et al. | 362/299 |
| 5,029,060 | A * | 7/1991 | Aho et al. | 362/299 |
| 5,150,966 | A * | 9/1992 | Nelson | 362/337 |
| 5,329,438 | A * | 7/1994 | Thompson | 362/431 |
| 7,229,192 | B2 * | 6/2007 | Mayfield et al. | 362/223 |
| 7,261,435 | B2 * | 8/2007 | Gould et al. | 362/223 |
| 2005/0281023 | A1 * | 12/2005 | Gould et al. | 362/217 |
| 2005/0281024 | A1 * | 12/2005 | Mayfield et al. | 362/221 |

* cited by examiner

*Primary Examiner*—Bao Q Truong
(74) *Attorney, Agent, or Firm*—Ballard Spahr Andrews & Ingersoll, LLP

(57) ABSTRACT

A light fixture for directing light emitted from a light source toward an area to be illuminated, including a reflector assembly within which the light source is positioned and a lens assembly detachably secured to a portion of the reflector assembly such that a lens of the lens assembly overlies the light source and such that substantially all of the light emitted from the light source passes through the lens assembly.

20 Claims, 31 Drawing Sheets

VOLUMETRIC DOWNLIGHT LIGHT FIXTURE

This application claims priority to and the benefit of U.S. Provisional Application No. 60/759,365, entitled "Volumetric Downlight Light Fixture," filed on Jan. 17, 2006, which is incorporated in its entirety in this document by reference.

BACKGROUND OF THE INVENTION

1. Field of the Invention

The present invention generally relates to light fixtures for illuminating architectural spaces, and, more particularly, to downlight light fixtures for illuminating the desired space.

2. Background Art

Numerous light fixtures for architectural lighting applications are known. In the case of fixtures that provide direct lighting, the source of illumination may be visible in its entirety through an output aperture of the light fixture or shielded by elements such as parabolic baffles or lenses. A light fixture presently used in a typical office environment comprises a troffer with at least one fluorescent lamp and a lens having prismatic elements for distributing the light. Also known are light fixtures that use shaped reflectors to provide a desired light distribution.

The choice of light fixture will depend on the objectives of the lighting designer for a particular application and the economic resources available. To meet his or her design objectives, the lighting designer, when choosing a light fixture, will normally consider a variety of factors including aesthetic appearance, desired light distribution characteristics, efficiency, lumen package, maintenance and sources of brightness that can detract from visual comfort and productivity.

An important factor in the design of light fixtures for a particular application is the light source. The fluorescent lamp has long been the light source of choice among lighting designers in many commercial applications, particularly for indoor office lighting. Some conventional fluorescent lamps, however, have a significant drawback in that the lamp surface is bright when compared to a lamp of larger diameter. The consequence of such bright surfaces is quite severe in applications where the lamps may be viewed directly, such as, for example a conventional downlight. Without adequate shielding, downlight fixtures employing such lamps are very uncomfortable and produce direct and reflected glare that impairs the comfort of the lighting environment. Heretofore, lamps have been devised to substantially diffuse the intensity of the lamp to mitigate problems associated with light sources of high surface brightness.

Conventional parabolic and downlight light fixture designs have several negative features. One of these is reduced lighting efficiency. Another is the so-called "cave effect," where the upper portions of walls in the illuminated area are dark. In addition, the light distribution of these fixtures often creates a defined line on the walls between the higher lit and less lit areas. This creates the perception of a ceiling that is lower than it actually is. Further, when viewed directly at high viewing angles, a conventional parabolic and/or downlight fixture can appear very dim or off.

The present invention overcomes the above-described disadvantages of downlight fixtures by providing a configuration that appears to a viewer as though it has a source of lower brightness, but which otherwise permits the light fixture to advantageously and efficiently distribute light generated by the selected lamp. The light fixture of the present invention reduces distracting direct glare associated with high brightness light sources used in direct or direct light fixtures. This reduction in glare is accomplished without the addition of lamps and the added costs associated therewith.

SUMMARY OF THE INVENTION

In one embodiment, the present invention relates to a volumetric downlight light fixture for efficiently distributing light emitted by a light source into an area to be illuminated. In one general aspect of the invention, the light fixture comprises a reflector assembly that supports the light source. The light fixture may also include a lens assembly positioned with respect to a portion of the reflector assembly to receive light emitted by the light source and distribute it such that glare is further reduced. In a preferred embodiment, the lens assembly receives and distributes substantially all of the light emitted by the light source.

Related methods of operation are also provided. Other systems, methods, features, and advantages of the volumetric downlight light fixture for distributing generated light will be or become apparent to one with skill in the art upon examination of the following figures and detailed description. It is intended that all such additional systems, methods, features, and advantages be included within this description, be within the scope of the volumetric downlight light fixture for distributing generated light, and be protected by the accompanying claims.

BRIEF DESCRIPTION OF THE FIGURES

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DETAILED DESCRIPTION OF THE INVENTION

Figure 1:
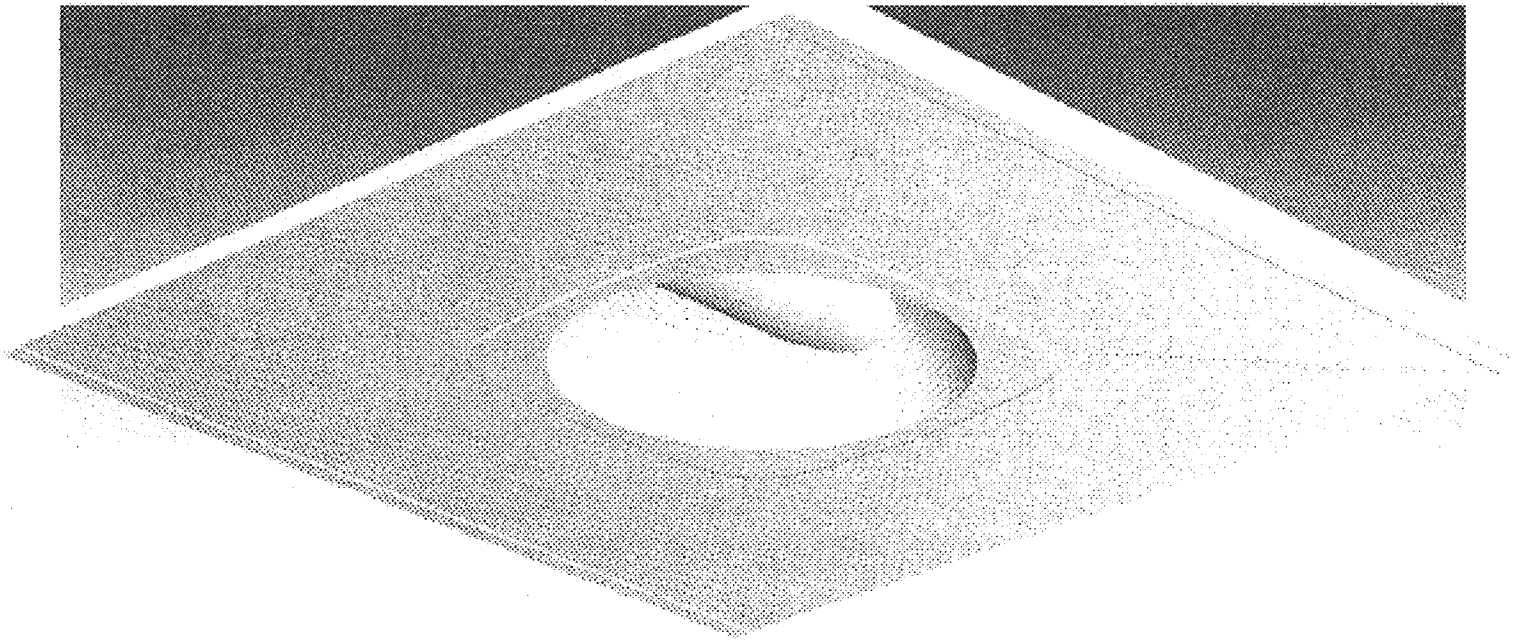
FIG. 1 is a perspective view of one embodiment of a volumetric downlight light fixture of the present invention, showing the fixture mounted therein a ceiling tile.
Figure 2:
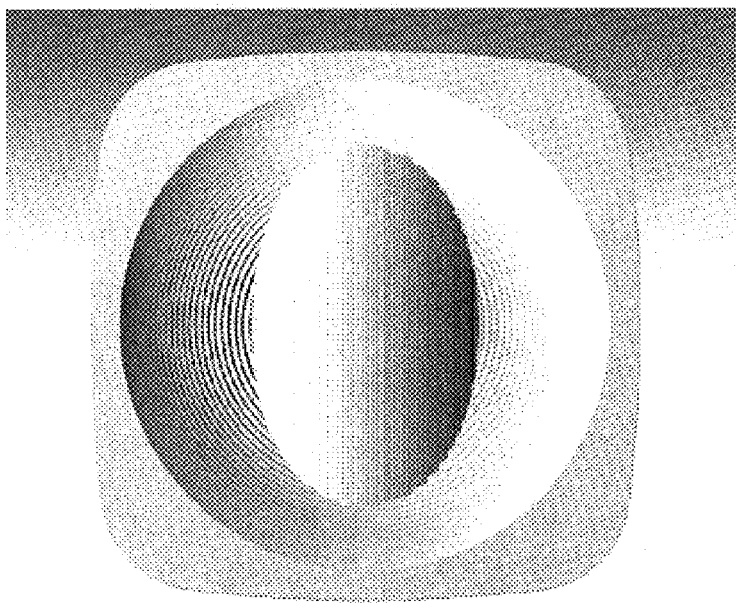
FIG. 2 is a bottom plan elevational view of the volumetric downlight light fixture of FIG. 1.
Figure 3:
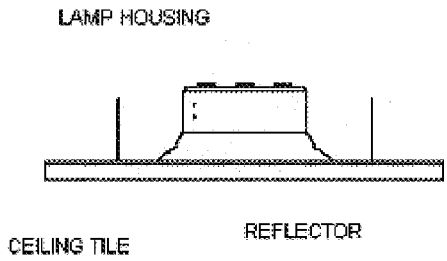
FIG. 3 is bottom plan elevational view of the volumetric downlight light fixture of FIG. 1, showing the fixture mounted therein a ceiling tile.
Figure 4:
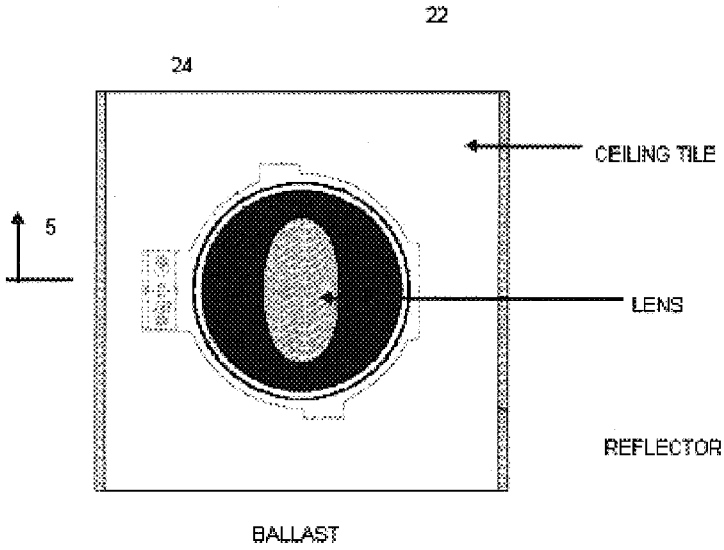
FIG. 4 is a side elevational view of the volumetric downlight light fixture of FIG. 3.
Figure 5:
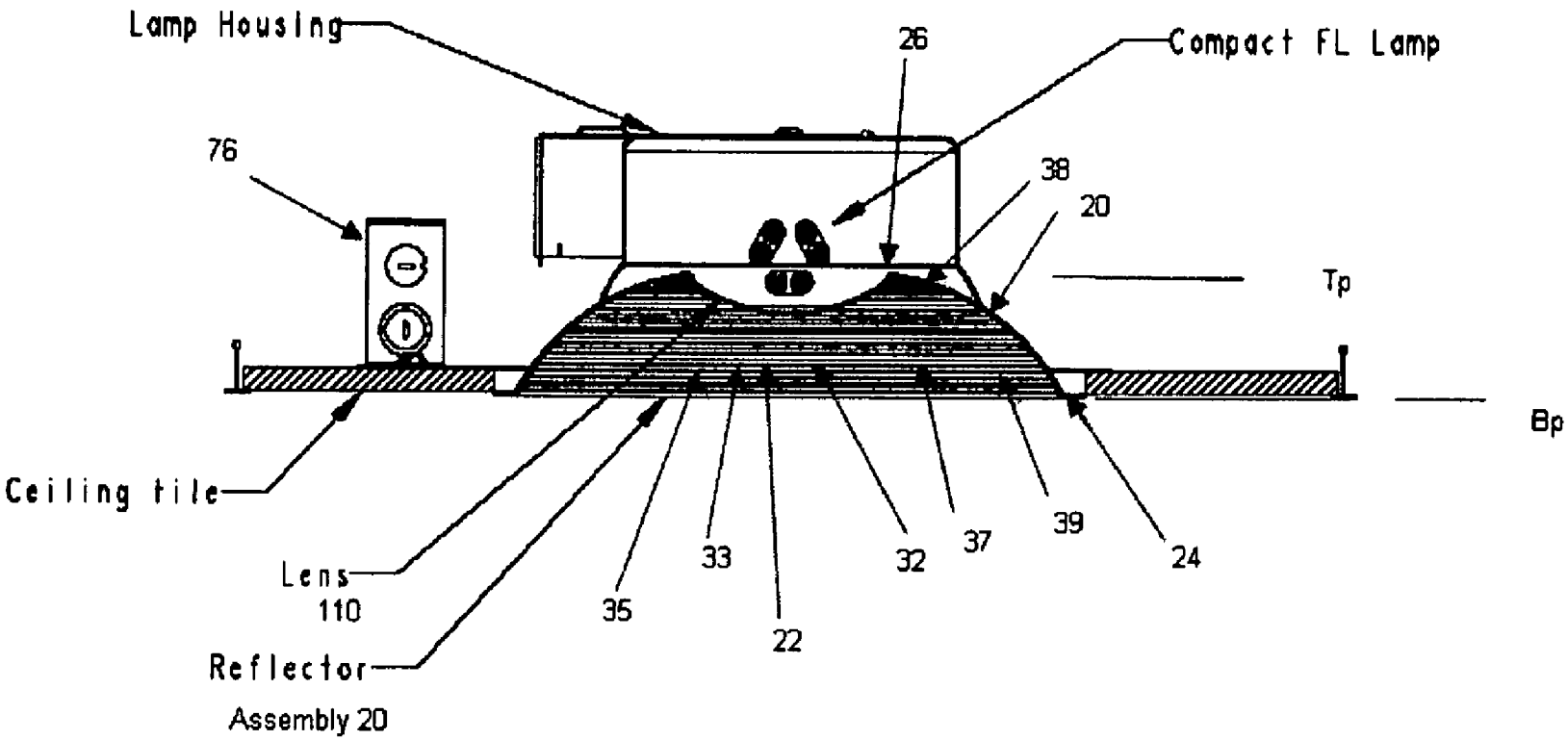
FIG. 5 is a cross-sectional view of the volumetric downlight light fixture of FIG. 3, taken along line 5-5.
Figure 6:
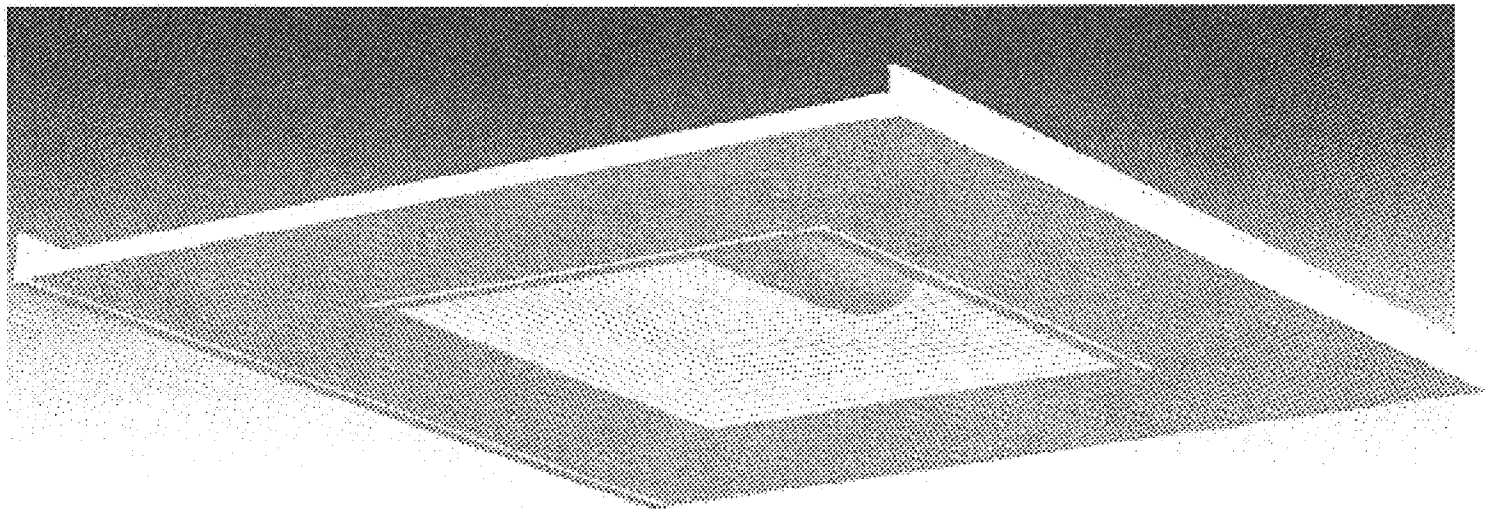
FIG. 6 is a perspective view of a second embodiment of a volumetric downlight light fixture of the present invention, showing the fixture mounted therein a ceiling tile.
Figure 7:
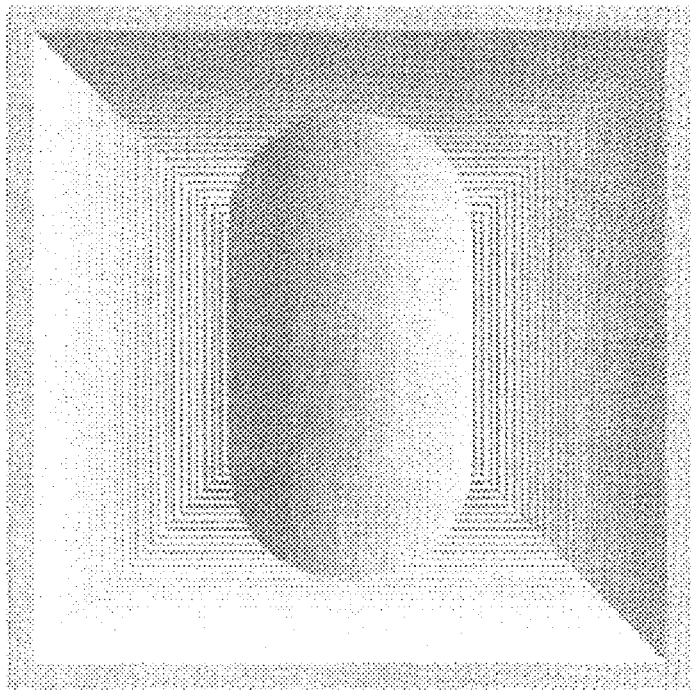
FIG. 7 is a bottom plan elevational view of the volumetric downlight light fixture of FIG. 6.
Figure 8:
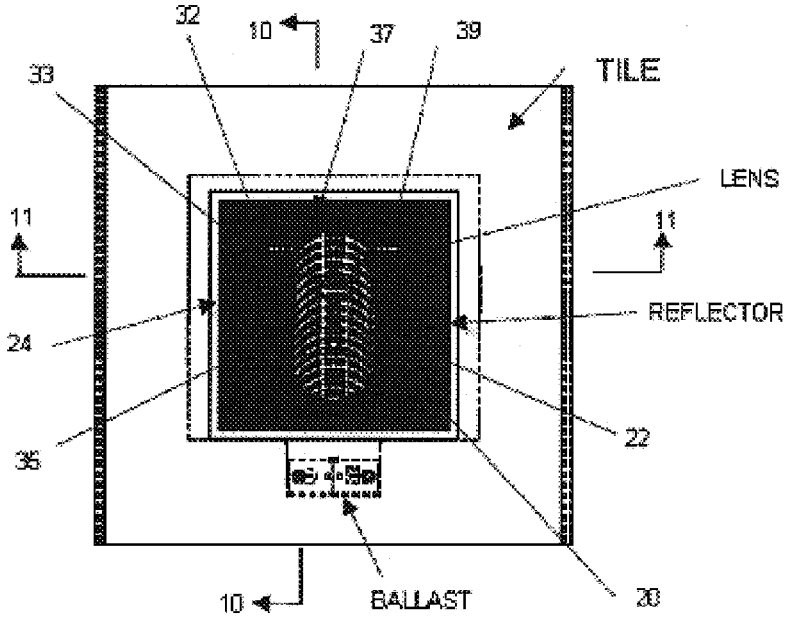
FIG. 8 is a bottom plan elevational view of the volumetric downlight light fixture of FIG. 6, showing the fixture mounted therein a ceiling tile.
Figure 9:
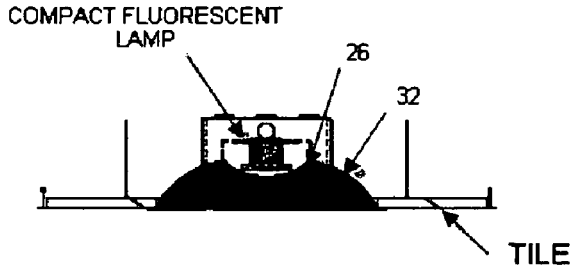
FIG. 9 is a side elevational view of the volumetric downlight light fixture of FIG. 8.
Figure 10:
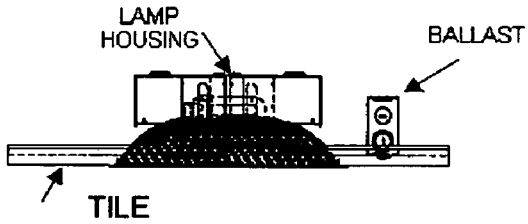
FIG. 10 is a cross-sectional view of the volumetric downlight light fixture of FIG. 8, taken along line 10-10.
Figure 11:
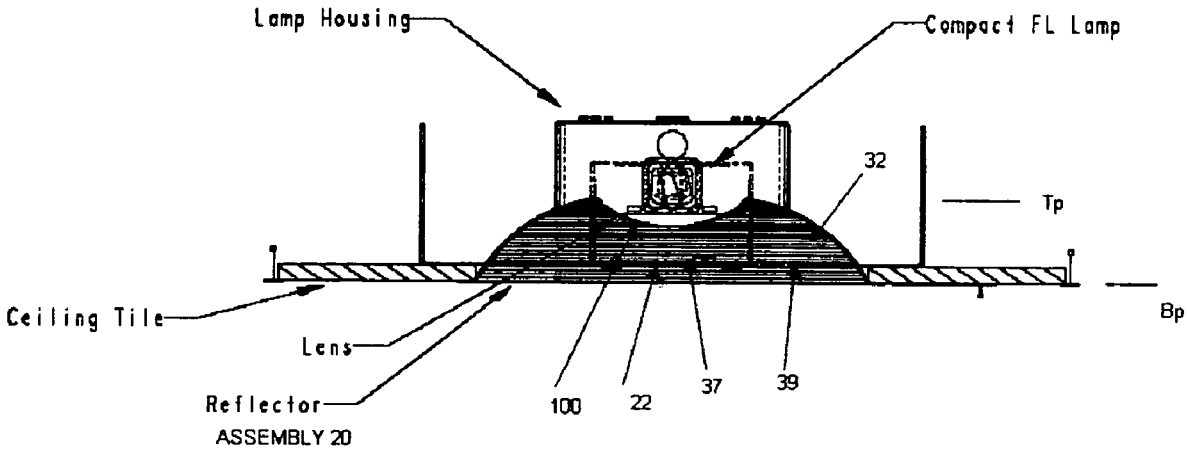
FIG. 11 is a cross-sectional view of the volumetric downlight light fixture of FIG. 8, taken along line 11-11.
Figure 12:
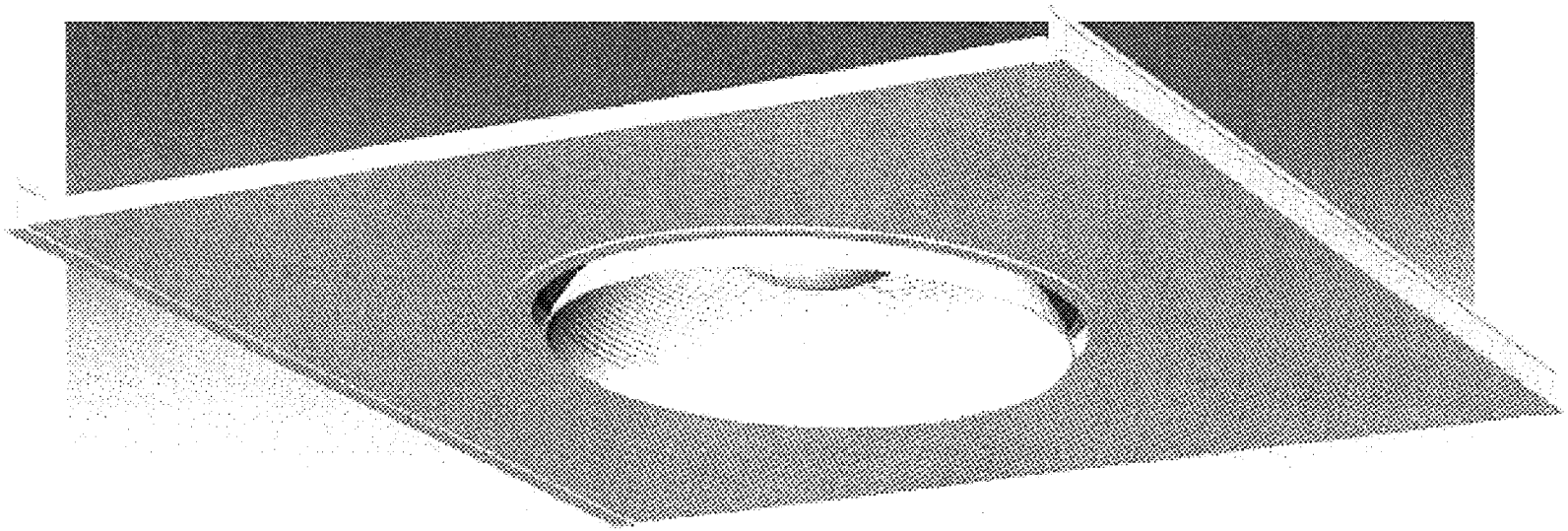
FIG. 12 is a perspective view of a third embodiment of a volumetric downlight light fixture of the present invention, showing the fixture mounted therein a ceiling tile.
Figure 13:
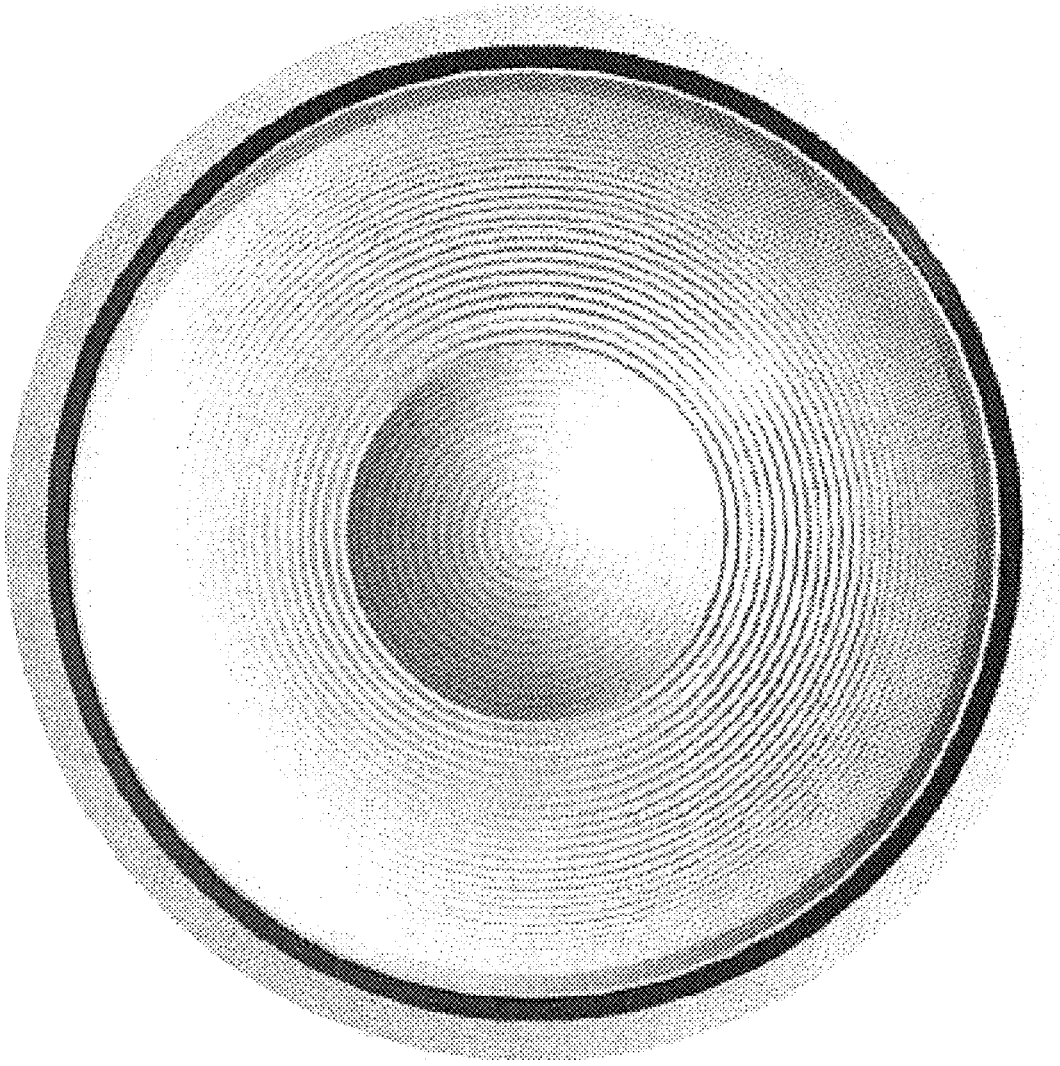
FIG. 13 is a bottom plan elevational view of the volumetric downlight light fixture of FIG. 12.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "surface" includes aspects having two or more such surfaces unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

Referring initially to FIGS. 1-11, a light fixture 10 of the present invention for illuminating an area includes a reflector assembly 20 for housing a light source 12. Light emanating from the light source 12 is diffused by a lens assembly 100 that is positioned between the light source 12 and the area to be illuminated. The light source 12 may be a conventional fluorescent lamp, and in one aspect, the light source 12 can be a conventional compact fluorescent lamp.

The reflector assembly 20 of the light fixture comprises a base member 22 that has a bottom peripheral edge 24, and defines an opening 26 positioned in a central portion 38 of the base member. The base member further comprises a base surface 30 that generally extends from the bottom peripheral edge to the opening. It is contemplated that the base member 22 can be formed from a single piece of material or from a plurality of adjoined pieces. As one will appreciate, the reflector assembly 20 of the light fixture can be formed from any code-compliant material. For example and not meant to be limiting, the base member of the reflector assembly can be formed from steel or aluminum.

In a further aspect of the present invention, at least a portion of the peripheral edge 24 of the base member is positioned in a bottom plane Bp and the opening of the base member is positioned in a top plane $T_p$ that is spaced a predetermined distance from the bottom plane. In this aspect, at least a portion of the base surface 30 of the base member 22 forms a hollow 32 that extends inwardly in the transverse dimension away from the peripheral edge 24 of the base member. Thus, the light fixture of the present invention extends upwardly from the bottom plane toward the opening 26 to define an interior volume that is recessed from the peripheral edge of the base member.

At least a portion of the surface of each formed hollow 32 preferably comprises a reflective surface 33 that extends generally between the central portion 38 and the peripheral edge 24 of the base member. In one embodiment, at least a portion of each hollow 32 has a generally curved sectional shape such that such that portions of the hollow 32 form a generally curved reflective surface 35 for diffusely reflecting light received from the lens into the architectural space in a desired pattern. In one aspect of the invention, at least one transverse section of the hollow can have a barrel shape. In an alternative embodiment, at least a portion of each hollow 32 can have at least one planar portion.

In one aspect, at least a portion of the hollow 32 of the base surface 30 of the base member can be painted or coated with a reflective material or formed from a reflective material. The reflective material may be substantially glossy or substantially flat. In one example, the reflective material is preferably matte white to diffusely reflect incident light.

In one aspect, the central portion 38 of the light fixture is generally symmetrically positioned within the light fixture. In a further aspect, the light source 12 is releaseably housed within a lamp housing that overlies the opening of the base member and is in operative communication with a light ballast. In one aspect, the reflector assembly is connected to the lamp housing. In one example, at least a portion of the light source 12 extends though the opening of the base member and into the interior volume of the hollow 32.

In one embodiment, at least a portion of the reflective surface 33 of the hollow 32 has a plurality of male ridges 37 formed thereon. In an alternative aspect, at least a portion of the reflective surface 33 of the hollow 32 has a plurality of female grooves 39 formed therein. In another aspect, each male ridge or female groove 37, 39 can extend substantially parallel to an adjoining male ridge or female groove. In operation, the ridges 37 or grooves 39 formed on the hollow 32 provide a diffusely reflecting surface.

In one exemplary aspect, at least a portion of the base surface 30 of the base member 22 has the plurality of male ridges 37 formed thereon, which, at least partially, surround the opening of the central portion of the base member. In an alternative aspect, at least a portion of the base surface 30 of the base member has the plurality of female grooves 39 formed thereon, which, at least partially, surround about the opening of the central portion of the base member.

In one exemplary aspect, and as shown in FIGS. 1, 2, 12, 13, 16 and 17, each ridge or groove 37, 39 has a generally circular circumferential shape when viewed from a bottom elevational plan view. One will appreciate that, in this example, a respective ridge or groove that is positioned closer to the peripheral edge 24 has a larger diameter than a ridge or groove that is positioned closer to the opening 26 in the base member. In this aspect, the respective ridge or groove extend, at least partially, concentrically about the opening of the central portion of the base member.

In another exemplary aspect, and as shown in FIGS. 6, 7, 14, 15, 18 and 19, each ridge or groove 37, 39 has a generally square or rectangular circumferential shape when viewed from a bottom elevational plan view. One will appreciate that, in this example, a respective ridge or groove that is positioned closer to the peripheral edge 24 has a larger circumferential shape than a ridge or groove that is positioned closer to the opening 26 in the base member. In this aspect, each respective ridge or groove extends, at least partially, about the opening of the central portion of the base member.

Similarly, in another aspect, each ridge or groove 37, 39 have a generally oval circumferential shape when viewed from a bottom elevational plan view. One will appreciate that, in this example, a respective ridge or groove that is positioned closer to the peripheral edge 24 has a larger circumferential shape than a ridge or groove that is positioned closer to the opening 26 in the base member. In this aspect, each respective ridge or groove extends, at least partially, about the opening of the central portion of the base member.

In another exemplary aspect, and as shown in FIGS. 20-23, the base member has a longitudinal axis and at least a portion of the respective plurality of ridges or grooves 37, 39 extends parallel to the longitudinal axis of the base member.

In one embodiment, is contemplated that each ridge or groove can have any desired geometric circumferential shape as long as each respective ridge or groove 37, 39 that is positioned closer to the peripheral edge 24 of the base member has a larger circumferential shape than a ridge or groove that is positioned closer to the opening 26 in the base member. In this aspect, the respective ridge or groove extends, at least partially, about the opening of the central portion of the base member.

As noted above, in one aspect of the invention, the light source 12 can be positioned between a portion of the base surface of the base member and the lens assembly. In another aspect of the invention, the light source 12 can be positioned therein the opening of the reflector assembly 20 such that at least a portion of the light source is positioned above the top plane of the base member. Alternatively, the light source 12 can be positioned therein the opening of the reflector assembly such that the light source is positioned substantially about or above a portion of central portion of the base member In one aspect, and as shown in FIGS. 20-23, the base member of the reflector assembly 20 can also comprise a first end face 50 and an opposed second end face 52. Each of the end faces extends upwardly from the peripheral edge of the base member toward the central portion of the base member. Each end face has a face longitudinal axis that forms an obtuse angle with respect to the longitudinal axis of the base member 22. The angled first and second end faces 50, 52 optically alter the apparent perspective of the light fixture and aesthetically give the light fixture a deeper appearance.

Figure 22:
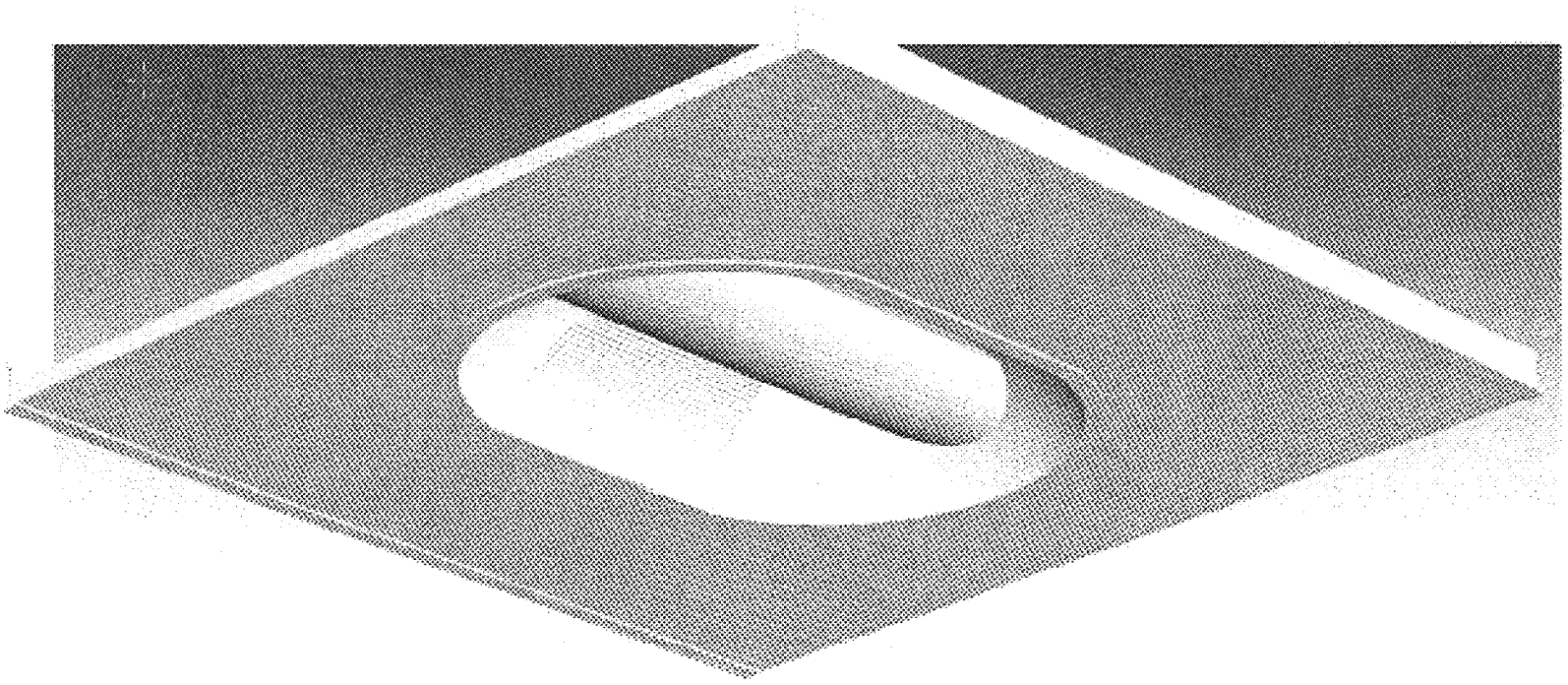
FIG. 22 is a perspective view of an eighth embodiment of a volumetric downlight light fixture of the present invention, showing the fixture mounted therein a ceiling tile.
Figure 23:
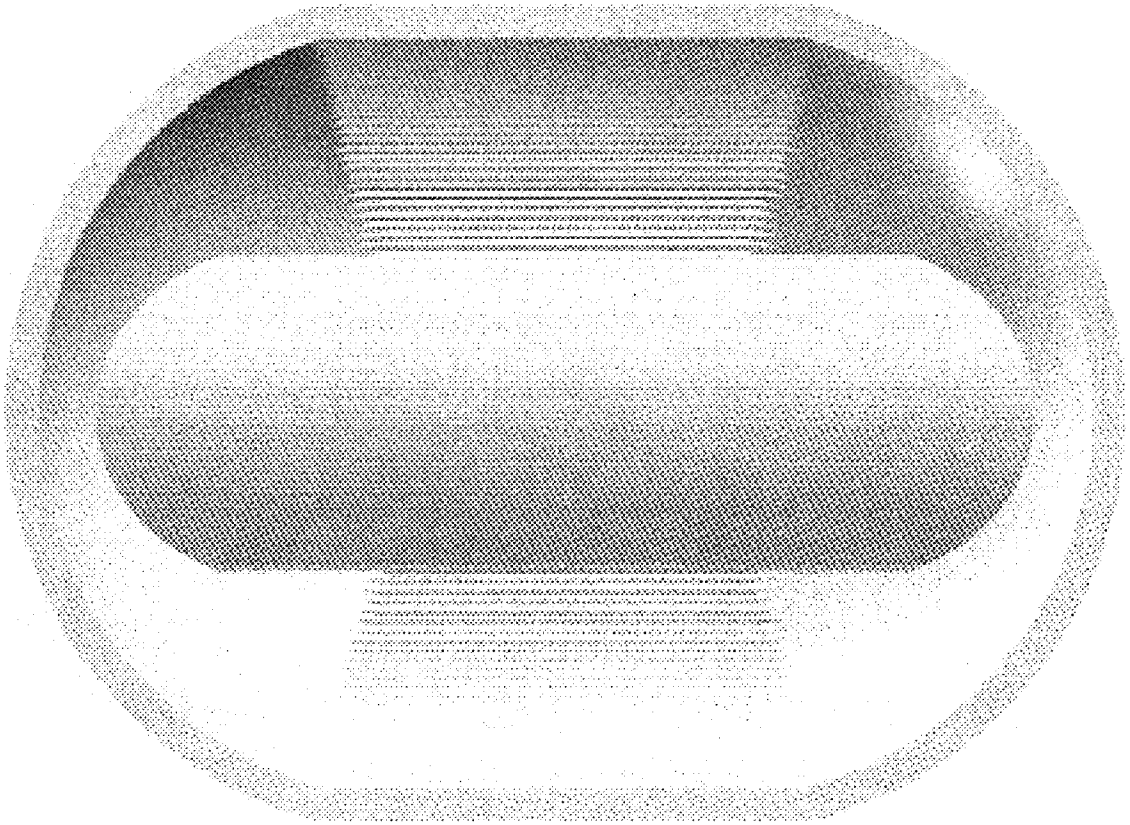
FIG. 23 is a bottom plan elevational view of the volumetric downlight light fixture of FIG. 22.
Figure 24:
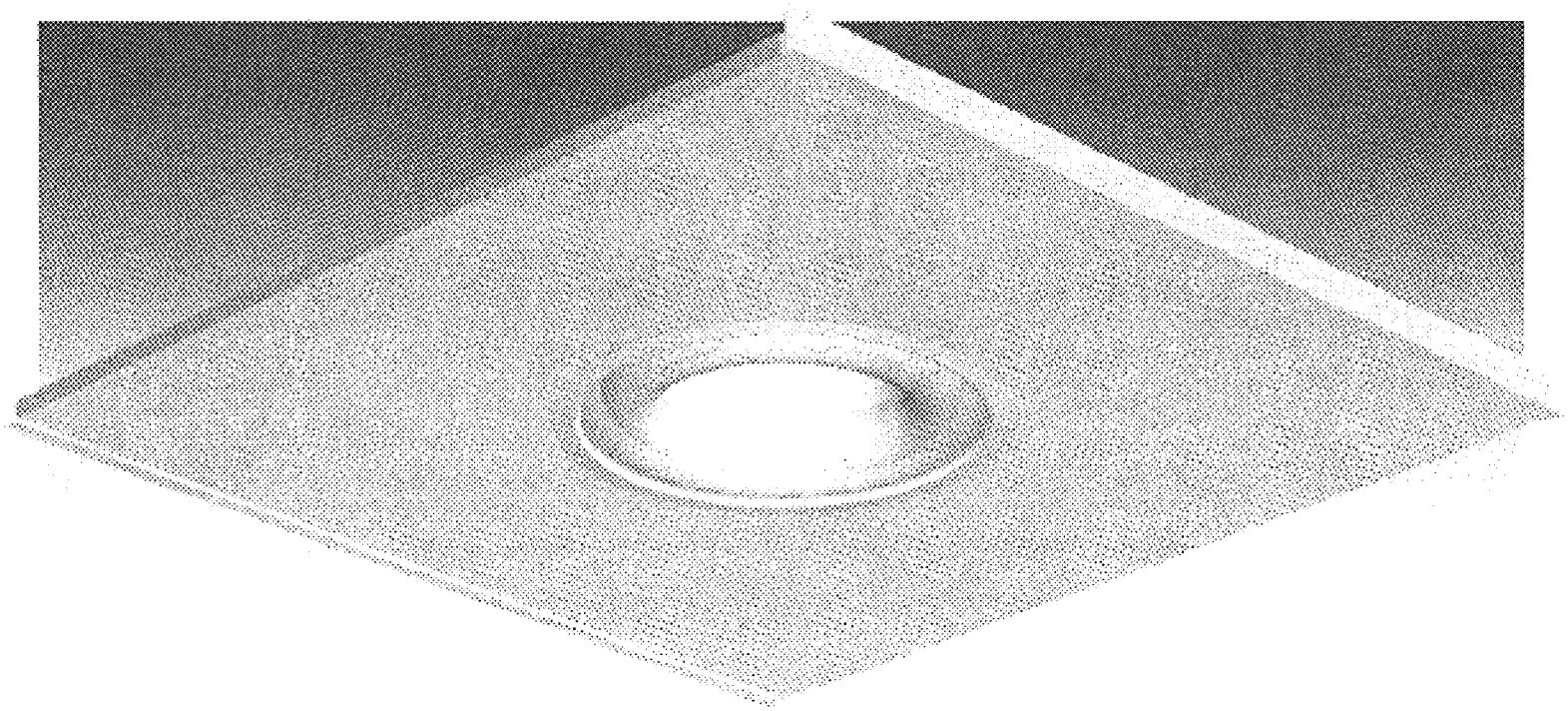
FIG. 24 is a perspective view of a ninth embodiment of a volumetric downlight light fixture of the present invention, showing the fixture mounted therein a ceiling tile.
Figure 25:
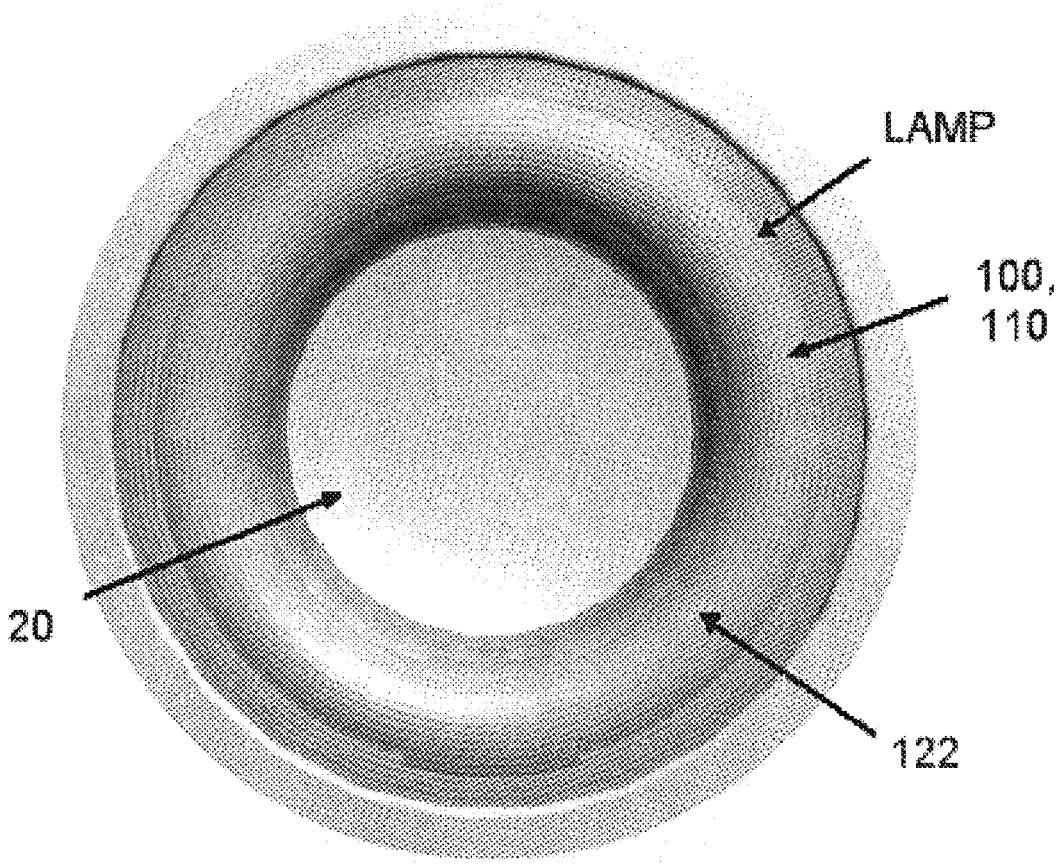
FIG. 25 is a bottom plan elevational view of the volumetric downlight light fixture of FIG. 24.
Figure 26:
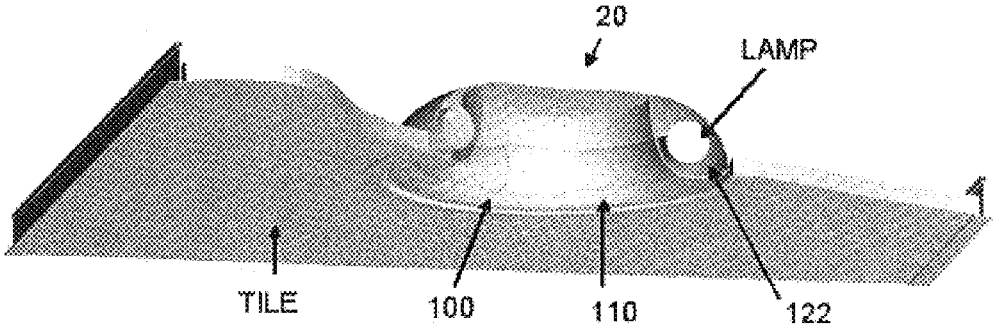
FIG. 26 is a partial broken away perspective view of the volumetric downlight light fixture of FIG. 24.

In one aspect, and as shown in FIGS. 22 and 23, from a bottom elevational view, at least a portion of the respective side edges of the first and second end faces can be curved in shape. Thus, in various aspects, it is contemplated that the juncture of the respective end faces and the side faces of the light fixture can form an angle relative to each other or can be smoothly curved.

In one aspect, the face longitudinal axis of each of the first and second end faces 50, 52 respectively forms an angle Ω of about and between 95° to 160° with respect to the base longitudinal axis of the base member 22. More particularly, the face longitudinal axis of each of the first and second end faces respectively forms an angle Ω of about and between 100° to 150° with respect to the base longitudinal axis. Still more particularly, the face longitudinal axis of each of the first and second end faces respectively forms an angle Ω of about and between 100° to 135° with respect to the base longitudinal axis. In another aspect, the face longitudinal axis of each of the first and second end faces respectively forms an angle Ω of about 120° with respect to the base longitudinal axis. In yet another aspect, the respective obtuse angles formed between the face longitudinal axis of the first end face 50 and the face longitudinal axis of the second end face 52 and the base longitudinal axis of the base member 22 are substantially equal.

As exemplified in the figures, alternative shapes of the first and second end faces 50, 52 are contemplated. Each of the first and second end faces may be substantially planar or non-planar. In the non-planar embodiments, portions of the first and second end faces are curved. The curved portions of the first and second end faces can be substantially concave or substantially convex. As described above, in alternative aspects, portions of the first and second end faces of the base member can also have male ridges 37 or female grooves 39 formed thereon.

The lamp housing is configured to mount a conventional electrical contact or receptacle for detachably securing a selected end of the light source thereto. It is contemplated that the electrical contact can be mounted to any of the surfaces that define the interior of the lamp housing. As noted above, the light fixture 10 also includes at least one conventional light ballast 76 constructed and arranged for electrically connecting the light source to an external power source. In one aspect, the at least one ballast 76 is mounted to a top surface of the light fixture.

The lens assembly 100 of the present invention is constructed and arranged to direct light emitted by the light source 12 onto the area to be illuminated. A basic function of the lens assembly 100 is to diffuse the light from the light source 12 to effectively hide the light source 12 itself from view while reducing its brightness. Thus, one function of the lens assembly is to effectively become the source of light for the light fixture. This is accomplished in the preferred embodiment by providing the lens 110 of the lens assembly with a plurality of prismatic elements with short focal lengths. Because of the short focal lengths of the prismatic elements, the light from the light source is focused to parallel images very close to the surface of the lens at large angles of convergence. Because of the large angles of convergence, the images overlap and the light is essentially diffused. The diffused light is then either directed onto the surface to be illuminated without further reflection or is reflected by the reflective surfaces of the hollow 32. Thus, the lens assembly provides a diffuse source of lowered brightness.

In one aspect, the light source 12 is mounted in the opening of the base member and is recessed with respect to the peripheral edge 24 of the reflector assembly. This allows the lens 110 to be placed higher in the light fixture and provides geometric control of high-angle rays emanating from the lens. Thus, light rays produced at high viewing angles are physically blocked by the bottom peripheral edge of the light fixture. Further, the light fixture of the invention also optically controls glare. Thus, in this aspect, the light fixture of the invention prevents glare at high viewing angles through two mechanisms, geometrically and/or optically, depending on the viewer's respective position relative to lens assembly of the light fixture. In operation, the lens 110 of the lens assembly is positioned with respect to the reflector assembly 20 of the light fixture such that substantially all of the light emitted by the light source 12 passes through the lens 110 prior to impacting portions of the reflective surfaces 33 of the reflector assembly and/or prior to being dispersed into the surrounding area.

In one aspect, and as shown in FIGS. 1, 2, 6, 7, and 20-23, the lens assembly 100 includes a lens 110 having a first end edge 112, an opposed second end edge 113, and a central lens portion 114 that extends between the first and second edges. The central lens portion 114 has a lens longitudinal axis that extends between the first and second end edges. In one example, the lens longitudinal axis is generally parallel to the light longitudinal axis of the light source 12. In other exemplary aspects of the invention, and as exemplarily illustrated in FIGS. 12-19, the lens 110 has a generally circular, rectangular, square, or oval shape. Of course, other geometric shapes for the lens 110 are contemplated. In one further example, as shown in FIGS. 24-32, the lens has a generally toric shape.

The lens 110 can be made from any suitable, code-compliant material such as, for example, a polymer or plastic. For example, the lens 110 can be constructed by extruding pellets of meth-acrylate or polycarbonates into the desired shape of the lens. The lens 110 can be a clear material or translucent material. In another aspect, the lens can be colored or tinted.

In one embodiment, at least a portion of the lens has a prismatic surface 116 on a face 118 of the lens that is either spaced from and facing toward the light source 12 or, alternatively, spaced from and facing away from the light source 12. In one aspect of the invention, at least a portion of the lens 110 is curved in cross-section such that at least a portion of the face 118 of the central lens portion has a concave or convex shape relative to the light source. In an alternative embodiment, at least a portion of the lens is planar in cross-section.

In one aspect, the lens 110 is positioned within the reflector assembly so that it is recessed above the bottom plane of the base member. In a further aspect, the lens is recessed within the reflector assembly such that a plane bisecting the peripheral edge of the base member and a tangential portion of the lens is oriented at an acute angle γ to the generally horizontal bottom plane. In one aspect, the acute angle γ is about and between 3° to 30°. More particularly, the acute angle γ is about and between 05° to 20°. Still more particularly, the acute angle γ is about and between 10° to 15°.

The recessed position of the lens assembly within the reflector assembly provides for high angle control of light emitted by the light fixture in a vertical plane. In use, an observer approaching the ceiling mounted light fixture of the present invention would not see the lens assembly until they passed into the lower viewing angles. In effect, portions of the reflector assembly act to block the view of the lens assembly from an observer at the higher viewing angles (i.e., the viewing angles closer to the horizontal ceiling plane).

In one aspect, the prismatic surface 116 of the lens defines an array of elongated prismatic elements 120. In one example, as shown in FIGS. 1, 2, 6, 7, and 20-23, each prismatic element 122 thereof can extend linearly substantially longitudinally between the first and second edge edges 112, 114 of the lens. Alternatively, each prismatic element 122 thereof can extend linearly at an angle relative to a lens longitudinal axis. For example, each prismatic element thereof can extend generally transverse to the lens longitudinal axis.

In a further aspect, as shown in FIGS. 12, 13 and 16-19, each prismatic element can have a generally circular circumferential shape in which each successive and adjacent prismatic element extends substantially parallel to its adjoining prismatic element. One would appreciate that, in this example, a respective prismatic element that is positioned closer to the outer edge of the lens has a larger diameter than a prismatic element that is positioned closer to the center of the lens. In this aspect, the respective prismatic elements extend, at least partially, concentrically about the center of the lens.

Figure 14:
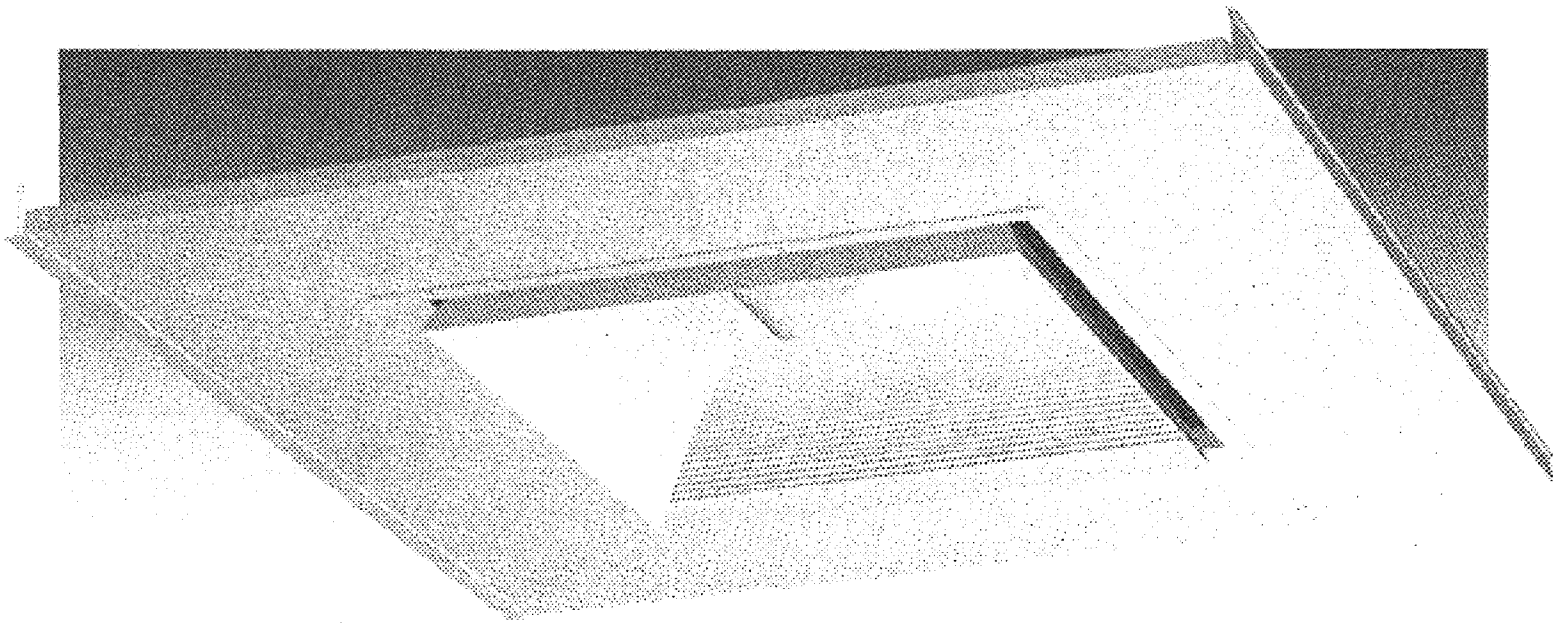
FIG. 14 is a perspective view of a fourth embodiment of a volumetric downlight light fixture of the present invention, showing the fixture mounted therein a ceiling tile.
Figure 15:
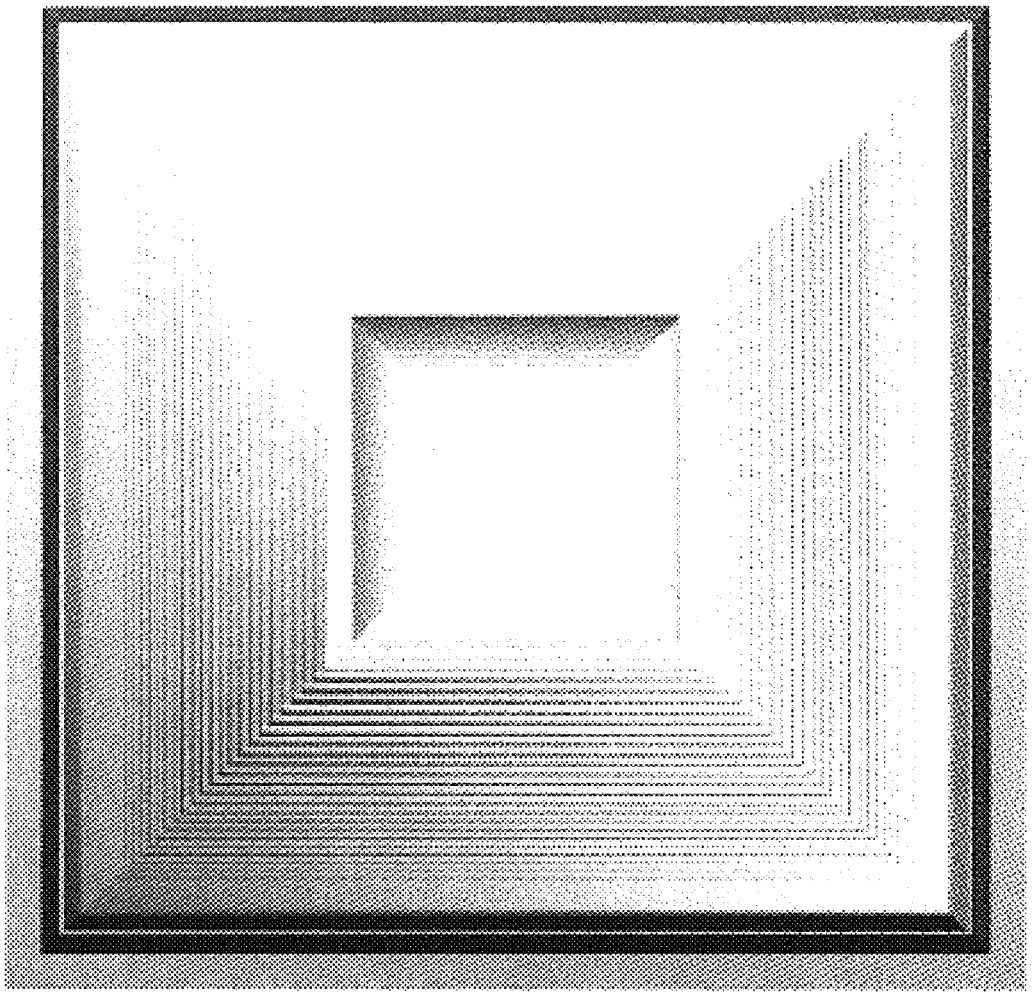
FIG. 15 is a bottom plan elevational view of the volumetric downlight light fixture of FIG. 14.
Figure 16:
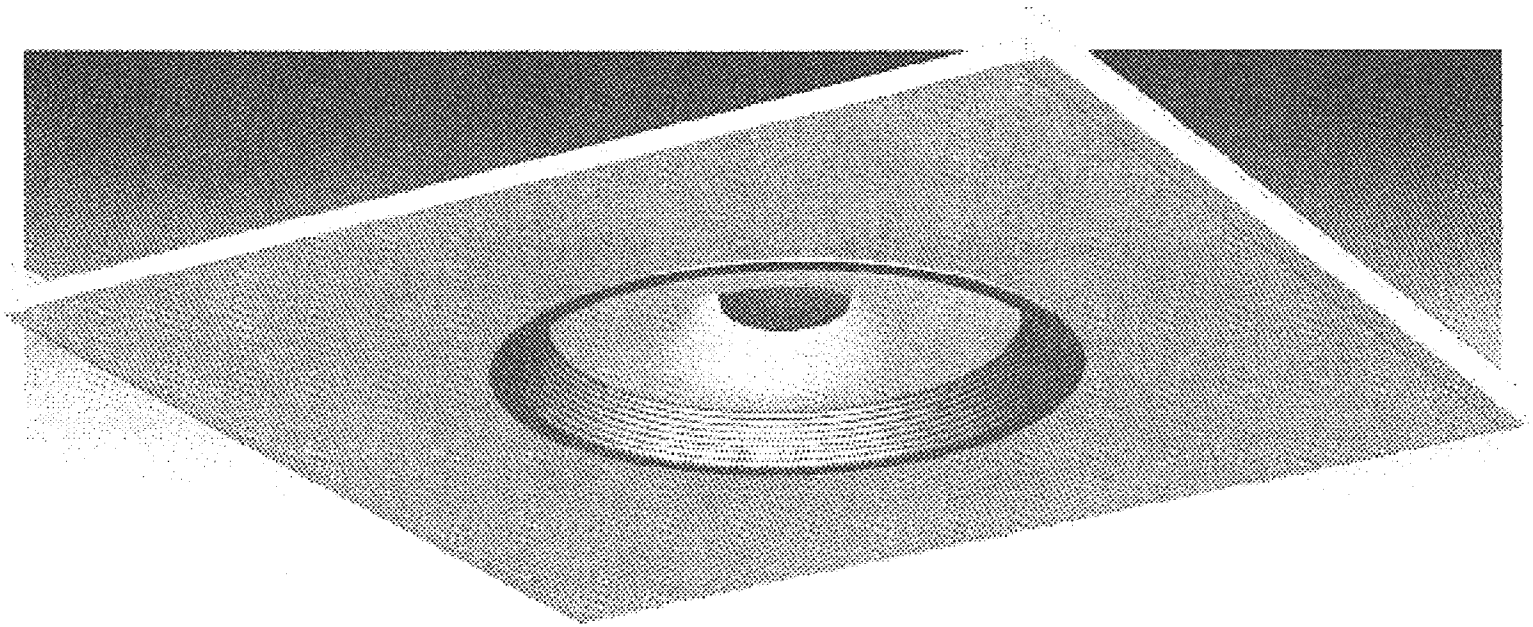
FIG. 16 is a perspective view of a fifth embodiment of a volumetric downlight light fixture of the present invention, showing the fixture mounted therein a ceiling tile.
Figure 17:
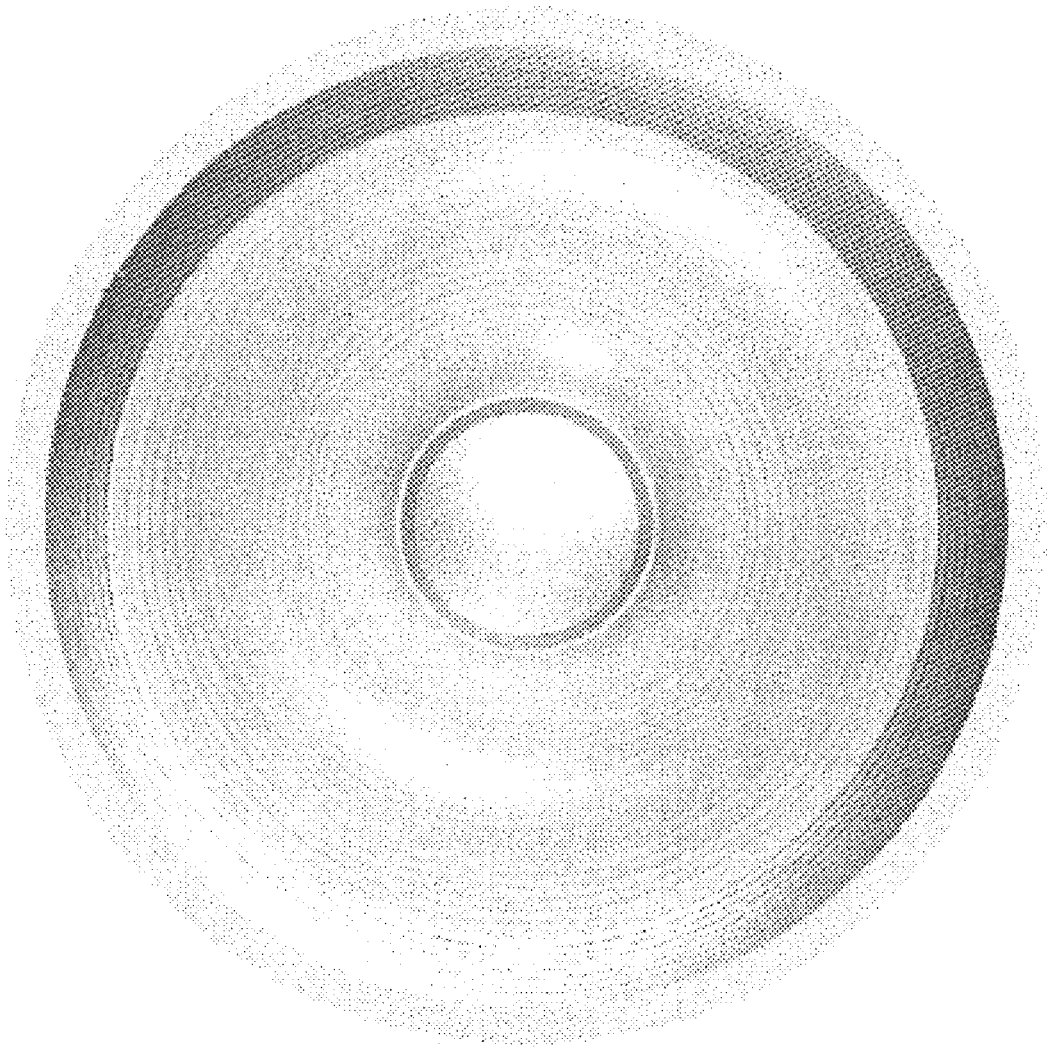
FIG. 17 is a bottom plan elevational view of the volumetric downlight light fixture of FIG. 16.
Figure 18:
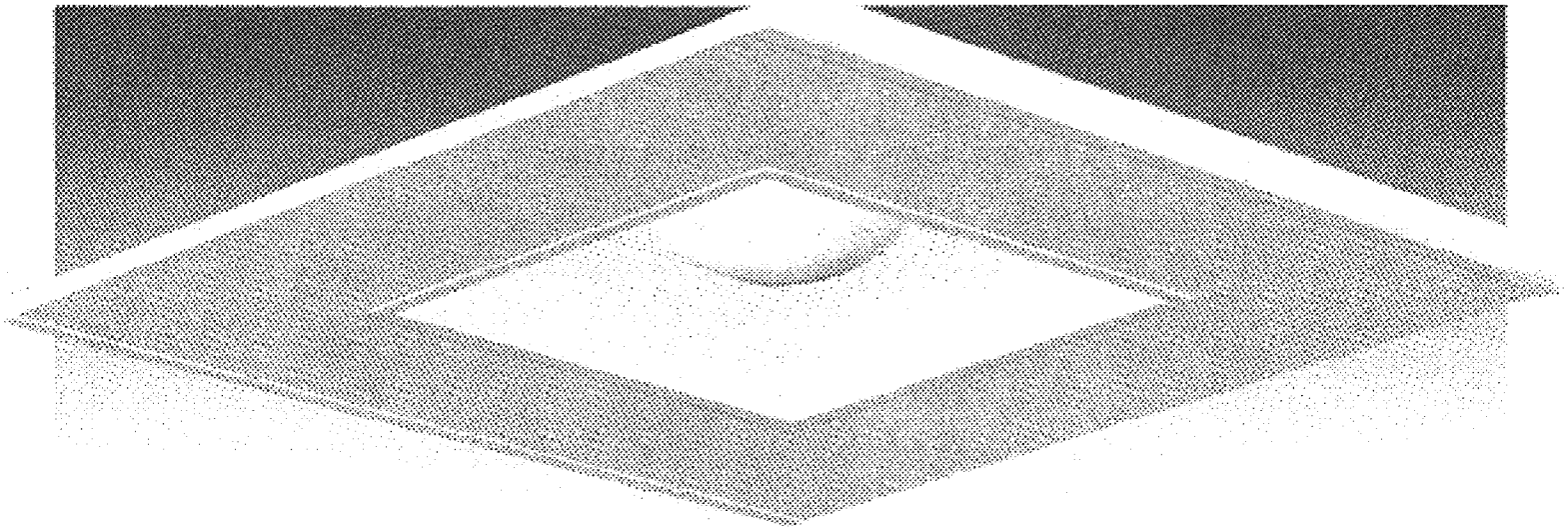
FIG. 18 is a perspective view of a sixth embodiment of a volumetric downlight light fixture of the present invention, showing the fixture mounted therein a ceiling tile.
Figure 19:
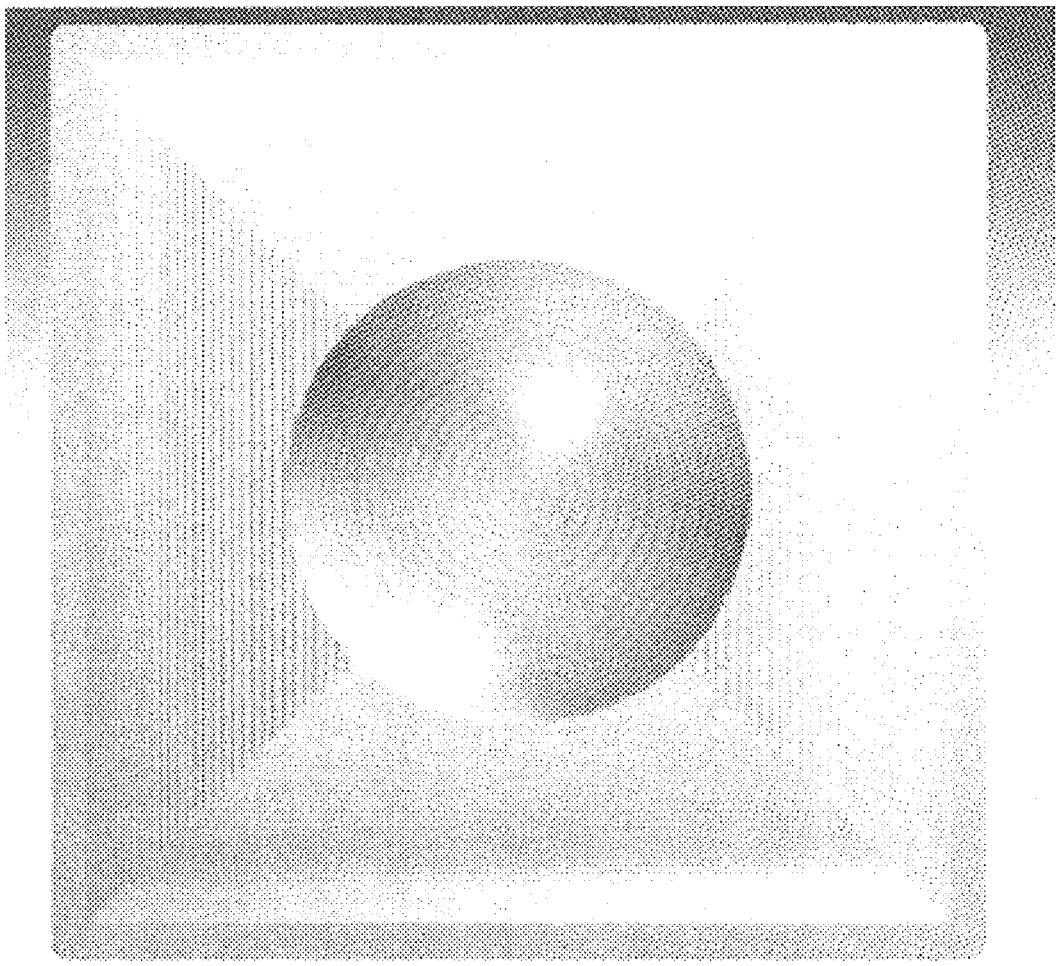
FIG. 19 is a bottom plan elevational view of the volumetric downlight light fixture of FIG. 18.
Figure 20:
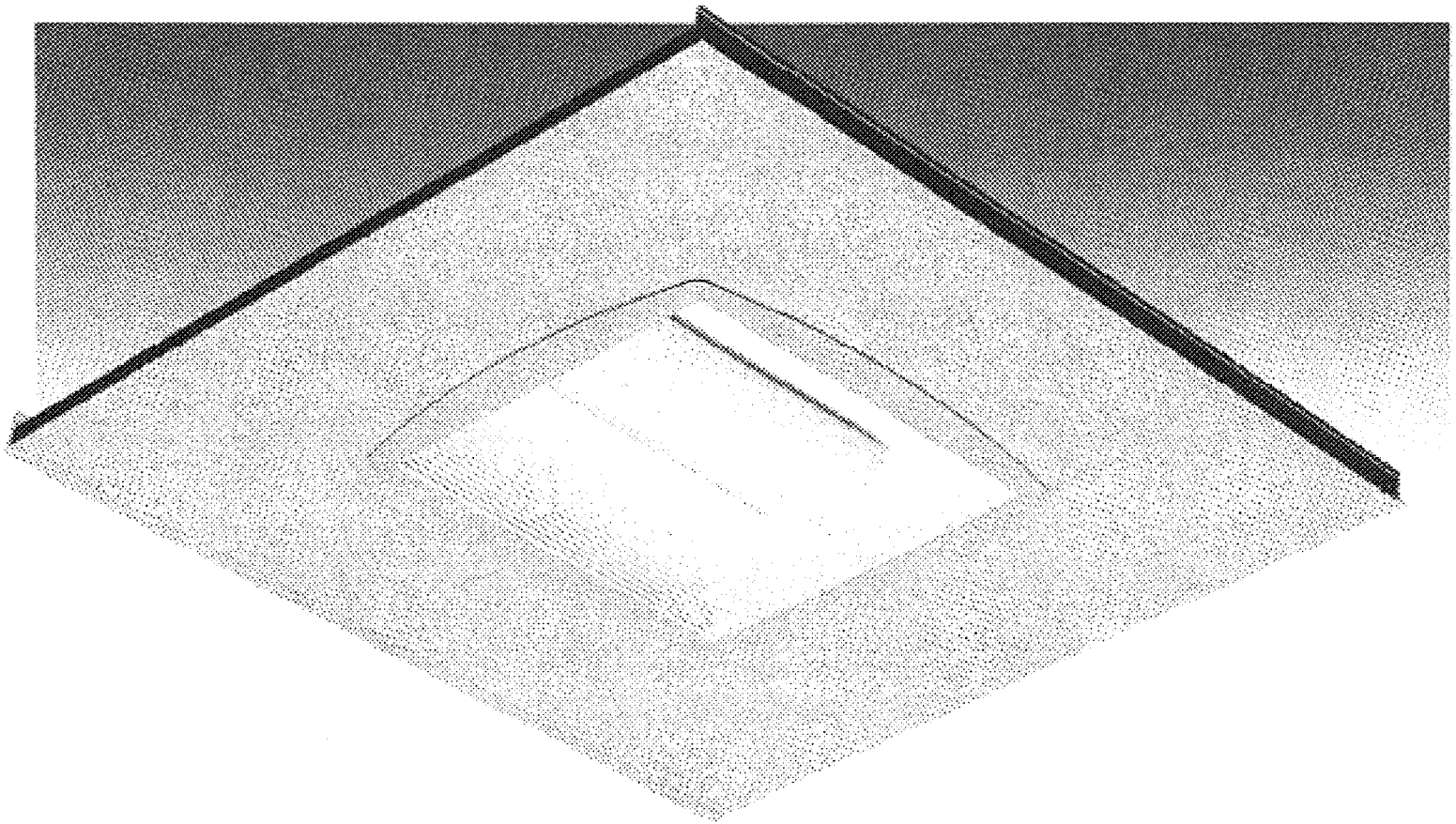
FIG. 20 is a perspective view of a seventh embodiment of a volumetric downlight light fixture of the present invention, showing the fixture mounted therein a ceiling tile.
Figure 21:
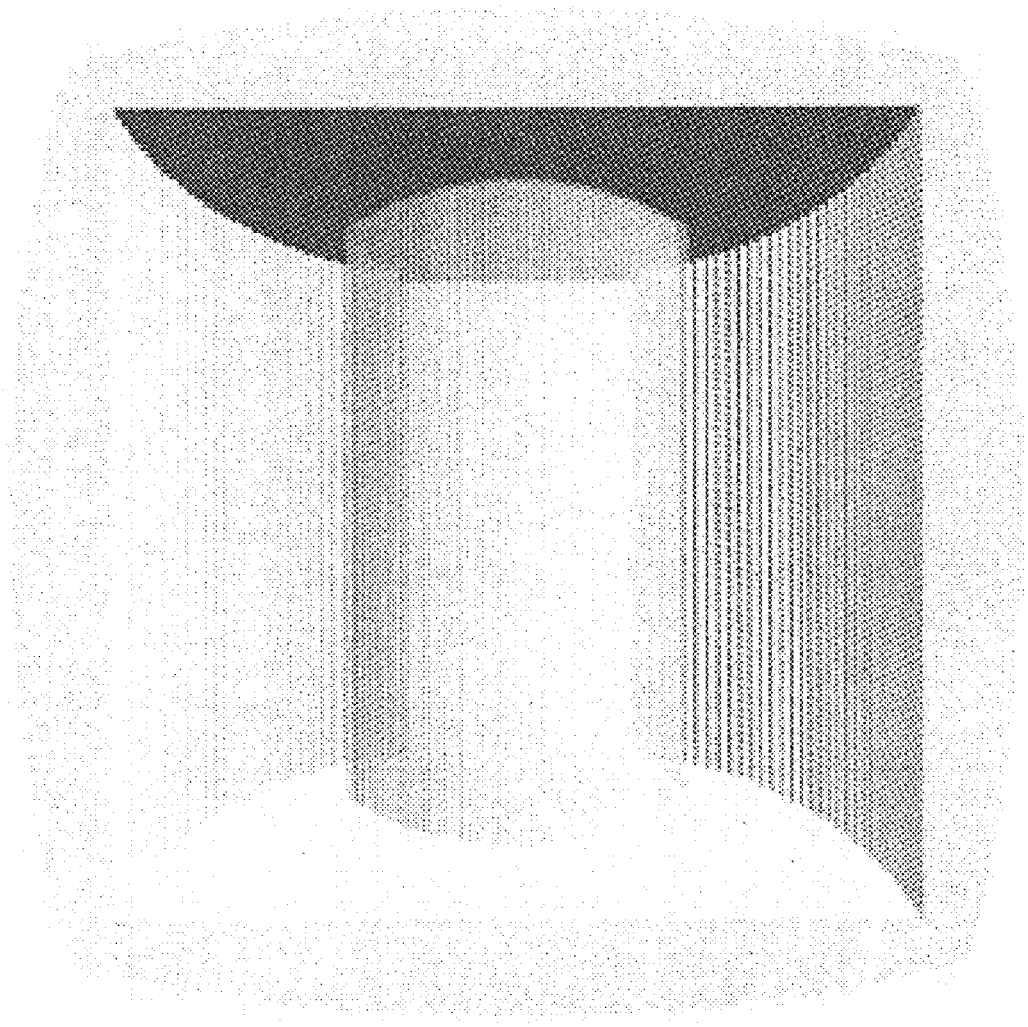
FIG. 21 is a bottom plan elevational view of the volumetric downlight light fixture of FIG. 20.

In a further aspect, as shown in FIGS. 14-15, each prismatic element can have a generally square or rectangular circumferential shape in which each successive and adjacent prismatic element extends substantially parallel to its adjoining prismatic element. One would appreciate that, in this example, a respective prismatic element that is positioned closer to the outer edge of the lens has a larger circumferential shape than a prismatic element that is positioned closer to the center of the lens. In this aspect, the respective prismatic element extends, at least partially, about the center of the lens.

In a further aspect, each prismatic element 122 can have substantially the same shape or, alternatively, can vary in shape to effect differing visual effects on an external observer, lighting of the hollow surface, or light distribution to the room. In one aspect, each prismatic element has a portion that is rounded or has a curved surface.

Referring now to FIGS. 33-41, in one aspect, in section, each prismatic element has a base 124 and a rounded apex 126. Each prismatic element extends toward the apex 126 substantially perpendicular with respect to a tangent plane that extends through the base 124. In one aspect, an arcuate section or curved surface 128, of each prismatic element 122 subtends an angle β of about and between 85° to 130° with reference to the center of curvature of the arcuate section. More particularly, the arcuate section 128 of each prismatic element forms an angle β of about and between 90° to 120°. Still more particularly, the arcuate section 128 forms an angle β of about and between 95° to 110°. In another aspect, the arcuate section 128 forms an angle β of about 100°.

In one aspect, the arcuate section 128 extends from a first cusp edge 130 of the prismatic element 122 to an opposed second cusp edge 132. In this example, adjoining prismatic elements are integrally connected at a common cusp edge 130, 132, 133. Alternatively, the arcuate section 128 may be formed in a portion of the apex 126 of the prismatic element 122, such that adjoining prismatic element are integrally connected at a common edge 133. In this example, portions of the prismatic element 122 extending between the arcuate section and the common edge 133 can be planar or non-planer, as desired. It should be understood that other configurations and shapes are contemplated where the cross section of the optical elements is not strictly circular, and includes, for example, parabolic, linear, or other shapes.

In one aspect, the base 124 of each prismatic element 122 has a width (w) between its respective common edges of about and between 0.5 inches to 0.01 inches. More particularly, the base of each prismatic element has a width between its respective common edges of about and between 0.3 inches to 0.03 inches. Still more particularly, the base of each prismatic element has a width between its respective common edges of about and between 0.15 inches to 0.05 inches.

Figure 34:
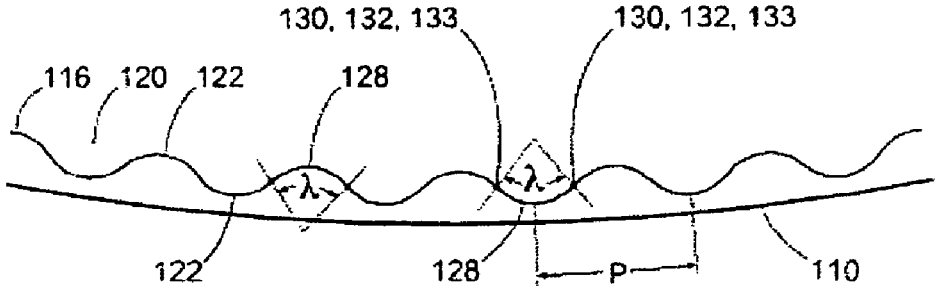
FIG. 34 is an enlarged partial sectional view of an exemplary lens assembly, showing an alternative embodiment of the array of prismatic elements.
Figure 35:
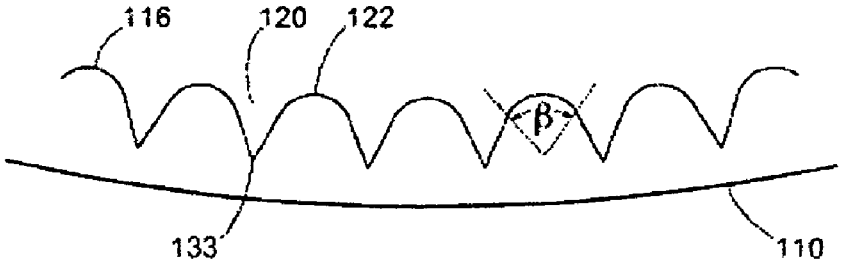
FIGS. 35 and 36 are enlarged partial sectional views of the lens assembly, showing still further alternative embodiments of the array of prismatic elements.
Figure 36:
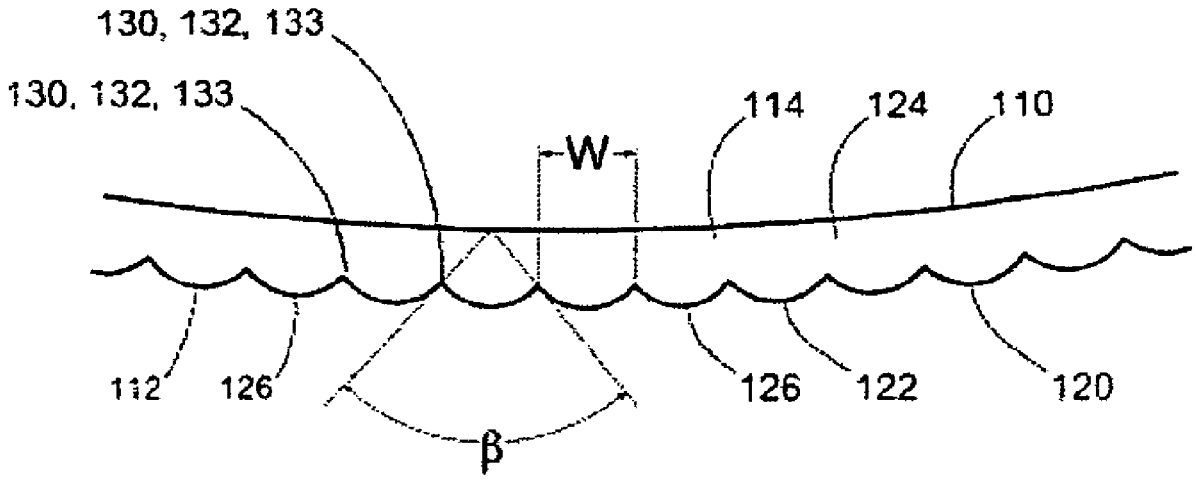
Figure 37:
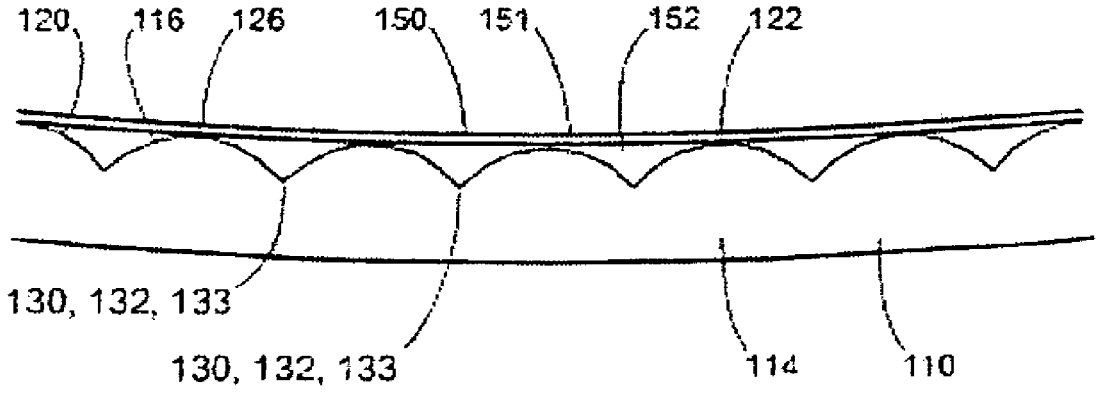
FIG. 37 shows an enlarged partial cross-sectional view of one embodiment of the lens assembly of the present invention with the diffuser inlay in registration with a portion of the prismatic surface of the lens.
Figure 38:
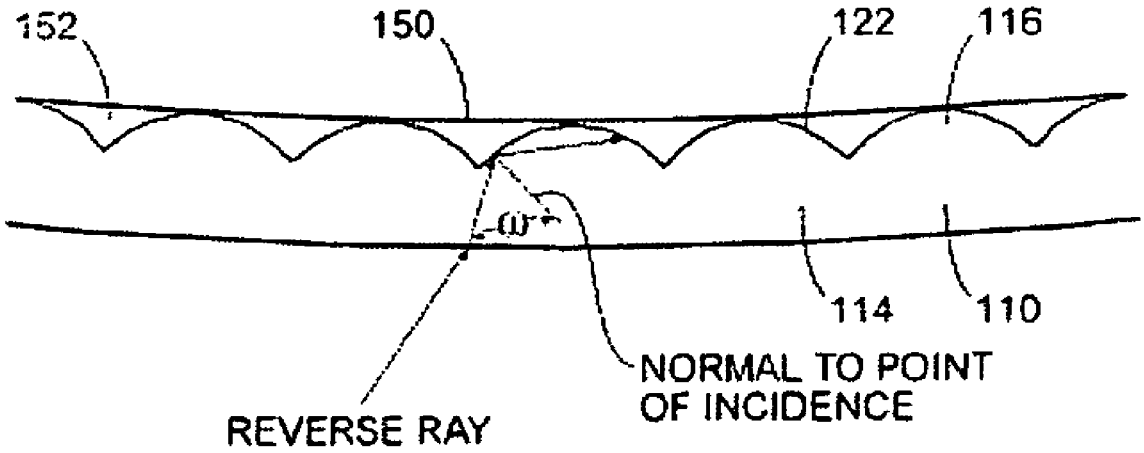
FIG. 38 shows an exemplary path of a reverse ray of light, in a vertical plane transverse to a section of the prismatic elements of the lens assembly, entering the face of the lens, the face being oriented away from the light source.
Figure 39:
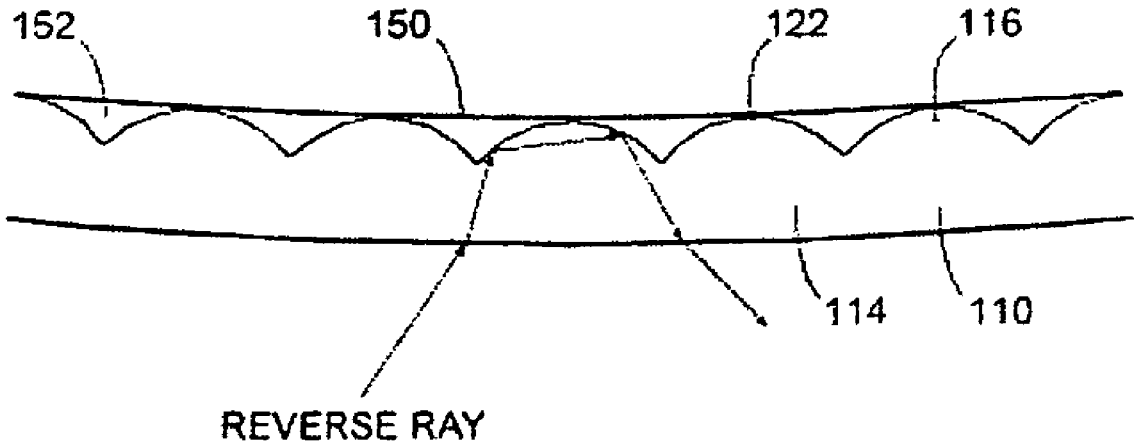
FIG. 39 shows an exemplary path of a reverse ray of light, in a vertical plane transverse to a section of the prismatic elements of the lens assembly, being rejected out of the face of the lens, the face being oriented away from the light source.
Figure 40:
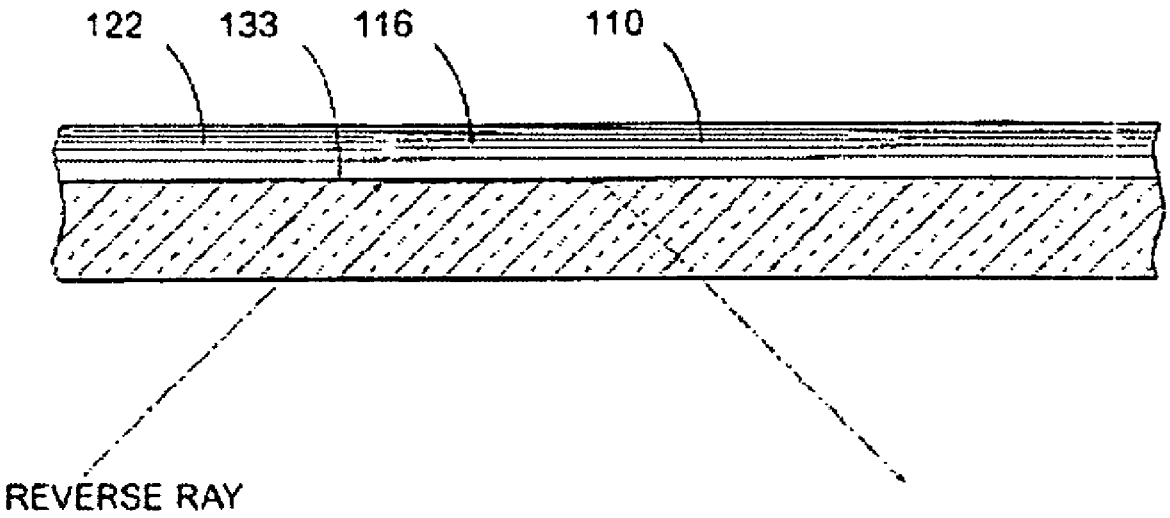
FIG. 40 shows an exemplary path of a reverse ray of light, in a vertical plane parallel to the longitudinal axis of a linear embodiment of a prismatic element of the lens assembly, entering the face of the lens and being rejected out of the face of the lens, the face being oriented away from the light.
Figure 41:
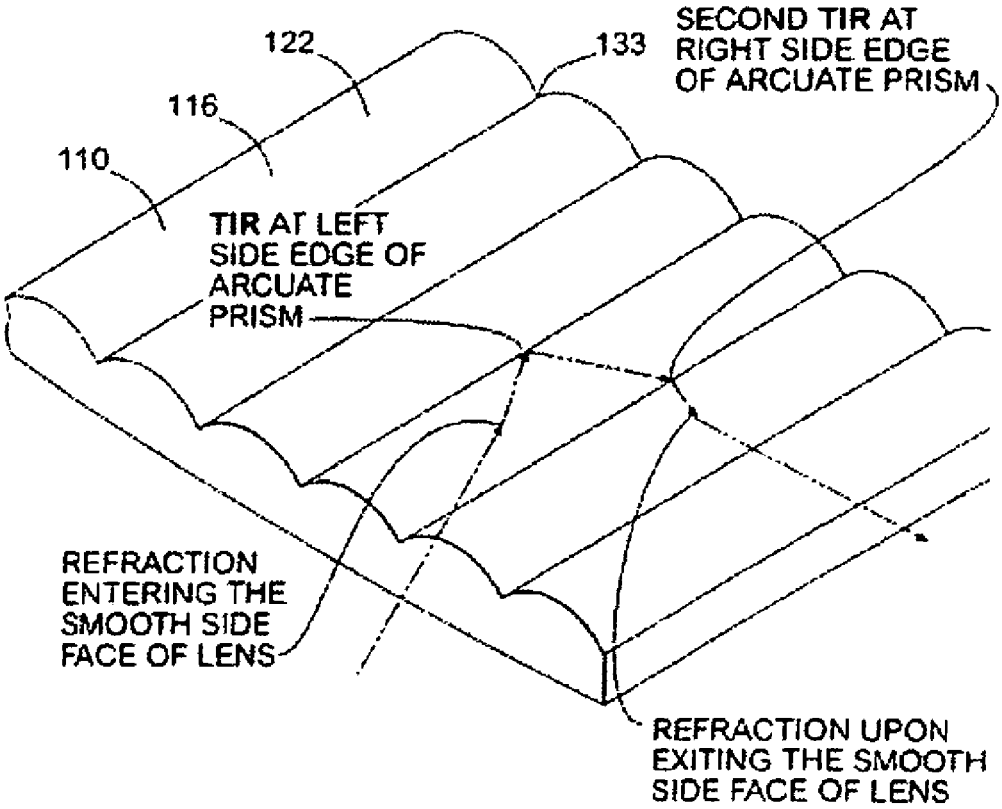
FIG. 41 is a perspective view of the exemplary path of a reverse ray of light.

In another aspect, as shown in FIG. 34, a section of the array of prismatic elements 120 has a shape of a continuous wave. In one aspect, the section is normal to the lens longitudinal axis. In one aspect, the shape of the continuous wave is a periodic waveform that has an arcuate section 128 formed in both the positive and negative amplitude portions of the periodic waveform (i.e., two prismatic elements are formed from each periodic waveform). The period of the periodic waveform can be substantially constant or may vary along the array of prismatic elements. In one aspect, the periodic waveform is a substantially sinusoidal waveform. In this example, the common cusp "edge" 130,132 between the two prismatic elements 122 forming from each periodic waveform occurs at the transition from positive/negative amplitude to negative/positive amplitude.

In one aspect, the arcuate section 128 of each prismatic element 122 within each of the positive and negative amplitude portions of the periodic waveform subtends an angle λ of about and between 85° to 130° with reference to a center of curvature of the arcuate section. More particularly, the arcuate section 128 of each prismatic element within each of the positive and negative amplitude portions of the periodic waveform forms an angle λ of about and between 90° to 120°. Still more particularly, the arcuate section 128 of each prismatic element within each of the positive and negative amplitude portions of the periodic waveform forms an angle λ of about and between 95° to 110° with respect to the base longitudinal axis. In another aspect, the arcuate sections 128 within each of the positive and negative amplitude portions of the periodic waveform form an angle λ of about 100°.

In one aspect, the period P of each prismatic element is about and between 1.0 inches to 0.02 inches. More particularly, the period P of each prismatic element is about and between 0.6 inches to 0.06 inches. Still more particularly, the period P of each prismatic element is about and between 0.30 inches to 0.10 inches.

In one aspect of the invention, the lens 110 of the light assembly 100 is constructed and arranged for detachable connection to the light fixture 10 or troffer. It is contemplated however that the lens 110 can be fixed to a portion of the light fixture 10 or, alternatively, can be formed integrally with a portion of the reflector assembly 20. In one aspect, when positioned relative to the base member 22, a central lens portion of the lens assembly can extend generally parallel to the light longitudinal axis and generally symmetric about a plane that extends through the light longitudinal axis. In one other aspect, the plane of symmetry extends through the area desired to be illuminated. In one example, the lens 110 is constructed and arranged for detachable connection to a portion of the base surface 30 of the reflector assembly 20.

In one exemplary aspect, in use, when the lens 110 is detachably secured to the reflector assembly 20, a portion of the lens overlies a portion of the reflective surface 33 of the hollow 32 adjacent the opening in the base members.

In another aspect, portions of the lens 110 that are positioned adjacent the surface of the reflective assembly 20 are sized and shaped to be in close overlying registration with portions of the reflector assembly when the lens 110 is detachably secured to the reflector assembly 20. Thus, the light source 12 housed within the lamp housing is substantially enclosed when the lens 110 is detachably secured to the reflector assembly 20.

The lens assembly 100 can also include a conventional diffuser inlay 150, such as, for example, a OptiGrafix™ film product, which is a diffuser film that can be purchased from Grafix® Plastics. The diffuser inlay 150 can be pliable or fixed in shape, transparent, semi-translucent, translucent, and/or colored or tinted. In one example, the diffuser inlay 150 has relatively high transmission efficiency while also scattering a relatively high amount of incident light to angles that are nearly parallel to its surface. In one aspect, the diffuser inlay is positioned between a portion of the face 118 of the central lens portion and the light source 12. In another aspect, the diffuser inlay is sized and shaped for positioning in substantial overlying registration with the portion of the face 118 of the central lens portion 114 that is oriented toward the light source 12.

The diffuser inlay 150 may be positioned in substantial overlying registration with a portion of the prismatic surface 116 of the central lens portion 114. In one aspect of the present invention, there is a gap 152 formed between portions of the two adjoining rounded prismatic elements 120 extending between the respective apexes of the two adjoined prismatic elements and the bottom face 151 of the diffuser inlay 150. The formed gap enhances the total internal refection capabilities of the lens assembly 100.

The lens assembly 100 and reflector assembly 20 of the present invention increases the light efficiency of the light fixture 10 and diffuses the light relatively uniformly so that the "cave effect" commonly noted in areas using conventional parabolic light fixtures in the ceiling are minimized. The light fixture of the present invention has reduced light control relative to conventional parabolic fixtures to provide a lit space (particularly the walls) with a bright appearance while still maintaining adequate control and comfortable viewing for today's office environment.

The light fixture 10 of the present invention has a low height profile that allows for easy integration with other building systems and installations in low plenum spaces. In one aspect, the height profile of the light fixture is about or below 5 inches. More particularly, the height profile of the light fixture is about or below 4 inches. In another aspect, the height profile of the light fixture is about 3.25 inches.

In one embodiment of the lens assembly 100 discussed above, the central lens portion 114 of the lens 110 has a concave face 118 oriented toward the light source 12 when the lens 110 is detachably secured to and within a portion of the reflector assembly 20. In use, the lens of the present invention design has a striped visual characteristic to an external observer when back lit. These "stripes" provide for visual interest in the lens 110 and may be sized and shaped to mirror any ridges or grooves 37, 39 disposed therein portions of the reflective surfaces 33 of the hollow 32 of the reflector assembly 20. The "stripes" also help to mitigate the appearance of the image of the lamp (the light source) by providing strong linear boundaries that breakup and distract from the edges of the lamp against the less luminous trough 40 of the reflector assembly 20. In addition, the "stripes" allow for the light fixture 10 of the present invention to provide high angle light control in vertical planes.

In a preferred embodiment, a primary function of the lens is to optically reduce the brightness of the light source. In addition, the lens reduces the brightness of the light source even further at higher viewing angles by the optical phenomenon of total internal reflection. This allows the efficient use of light sources of higher brightness while nevertheless reducing glare at high viewing angles.

It will be appreciated that the light fixture of the invention utilizes a unique combination of features to reduce high-angle glare. In operation, high angle glare is controlled by the geometric relationship between the lamp and the reflector assembly of the light fixture and by the lens optically. In the preferred embodiment, the lens itself essentially becomes the light source, which effectively reduces lamp brightness in both the transverse and longitudinal directions optically, to further reduce glare associated with lamps of high brightness.

Referring now to FIGS. 38-41, the exemplary optical creation of the dark "stripes" in the lens is illustrated. A "reverse ray," "backward ray" or "vision ray" is a light ray that originates from a hypothetical external viewer's eye and is then traced through the optical system of the light fixture. Although there is no physical equivalent, it is a useful construct in predicting how a particular optical element will look to an observer. In the present invention, on at least one side at the respective common cusp edges 130, 132, 133 of adjoining rounded prismatic elements 122, there exists a sufficiently large angle of incidence $\omega$ relative to the normal extending from the point of incidence of the reverse ray at the lens to air interface that a reverse ray will undergo total internal reflection. In one aspect, the angle of incidence $\omega$ is at least about 40°. More particularly, the angle of incidence $\omega$ is at least about 45. Still more particularly, the angle of incidence $\omega$ is at least about 50°. In effect, the array of prismatic elements acts as an array of at least partial light pipes.

Each rounded prismatic element 122 has a sufficiently large angular extent such that some total internal reflection at each common cusp edge is assured regardless of viewing angle. In one aspect, since each arcuate section 128 of each rounded prismatic element 122 is substantially circular, if a reverse ray undergoes total internal reflection at one portion of the arcuate section and is subsequently reflected to another portion of the arcuate section, then total internal reflection will also occur at the second point of incidence because the arcuate section's geometry causes both interactions to have substantially the same angle of incidence. Generally then, a reverse ray that undergoes total internal reflection proximate a common cusp edge 133 will eventually exit the lens 110 out the same outer surface through which it entered the lens and will terminate on a surface or object in the room (as opposed to passing through the lens and terminating on the light source or the trough of the reflector assembly behind the lens). The reverse ray is said to be "rejected" by the lens. This means that the brightness an external viewer will perceive at the common cusp edge 133 of adjoining rounded prismatic elements 122 is the brightness associated with a room surface because any real/forward light ray impinging on the viewer's eyes from this part of the lens must have originated from the room or space. Generally, the brightness of an object or surface in the room is much lower than that of the light source or trough that is viewed through the central portions of the arcuate sections 128 of each prismatic element 122. This high contrast in brightness between the common cusp edge 133 between adjoining rounded prismatic elements 122 and the central portion of the arcuate sections 128 of each prismatic element 122 is so high that it is perceived, to the external viewer, as "dark stripes" on a luminous background.

In one example, as shown in FIGS. 1, 2, 6, 7, and 20-23, the linear array of prismatic elements of the lens assembly optically acts in the longitudinal direction to reduce high angle glare. This may be explained by considering a reverse ray that is incident on a portion of the prismatic surface of the lens proximate the common cusp edge 133 at the critical angle (the minimum angle of incidence $\omega$) for total internal reflection of the reverse ray. An observer viewing that portion of the lens (i.e., the portion of the area about the common cusp edge) would perceive it as being "dark" relative to that adjacent "bright" portion of the arcuate section proximate the rounded apex of each individual prismatic element. Thus, in these examples, the array of linear elements optically controls the light emitted from the lamp in the longitudinal direction.

In one example, as the lens 110 is viewed at higher and higher viewing angles (as when the observer is further from the light fixture), the striping effect become more pronounced in a vertical plane that is parallel or near parallel to those portions of the prismatic elements of the lens. This is a result of the increase in that portion of the prismatic surface of the lens that undergoes total internal reflection and creates the dark strips. This results from viewing the lens at angles greater than the critical angle for total internal reflection of a "reverse ray." Thus, the effective width of each stripe grows as the lens is viewed at higher viewing angles, which is observed as the lens becoming dimmer at higher viewing angles.

Thus, it will be appreciated that higher view angle control is achieved through a combination of the high angle control proffered by the prismatic elements of the lens, as discussed immediately above, and the lens assembly being recessed within the reflector assembly. In one exemplary aspect, and as demonstrated in FIGS. 1, 2, 6, 7, and 20-23, in the vertical plane substantially parallel to the base longitudinal axis of the reflector assembly, the optical elements of the lens assembly, i.e., the array of prismatic elements, exert primary glare control of the higher viewing angles. In this aspect, in the vertical plane substantially transverse to the base longitudinal axis of the reflector assembly, the recessed position of the lens assembly within the reflector assembly exerts primary glare control of the higher viewing angles.

In one aspect, if the prismatic shapes 122 are regularly spaced apart, the striping effect would also be regularly spaced. In another aspect, the prismatic elements 122 of the present invention can be sized and shaped to ensure some total internal reflection at all viewing angles so that the "striping" is perceptible at all viewing angles.

In operation, normal movement of a viewer in the room does not change the viewer's vertical angle of view relative to the light fixture very rapidly and at far distances the stripes become less distinct. Therefore, the change is stripe width is not perceived as a dynamic motion but rather as a subtle changing of the overall lens brightness (i.e., brighter at low vertical angles and dimmer when viewed at high vertical angles).

The rounded or curved surfaced portions of each prismatic element 122 provide a wide spreading or diffusion of any incident light. The high degree of diffusion helps to obscure the image of the light source 12 as seen through the lens 110 even when the light source is in relatively close proximity to the face of the lens 110 that is oriented toward the light source. This becomes increasingly apparent as the lens is viewed at higher vertical angles in the vertical plane substantially parallel to the light source.

In another aspect, the rounded or curved surface portions of the prismatic elements 122 provides for a gradual change in the perceived brightness as a result of a change in the angle of view. In yet another aspect, in an embodiment of the invention in which each prismatic element 122 has substantially the same shape, the dark striping and the brighter areas of the lens 110 appear to change uniformly and smoothly from one prismatic element 122 to the next, adjoining prismatic element 122.

Referring now to FIGS. 24-32, additional alternative embodiments of the volumetric downlight light fixture 10 of the present invention are illustrated. These exemplary embodiments are configured for use with a circular fluorescent lamp. One skilled in the art would appreciate that the reflector assemblies 20 of these particular embodiments do not have an opening defined in the upper portion of the assembly. In one aspect, and referring initially to FIGS. 24-26, the lens assembly 100 is positioned at the bottom plane of the light fixture and has a generally toric shape configured for operative receipt of the circular fluorescent lamp. In this example, at least a portion of the lens assembly forms a visual bottom edge of the reflector. The reflector assembly 20 extends upwardly and around the lens assembly and substantially encloses the lamp. It is contemplated that the surface of the reflector assembly can have, as desired, ridges or grooves 37, 39 as desired. In operation, light is diffused optically via the prismatic elements 122 of the lens 110 and is reflected off of the overlying reflector assembly into the desired lighting environment.

Figure 27:
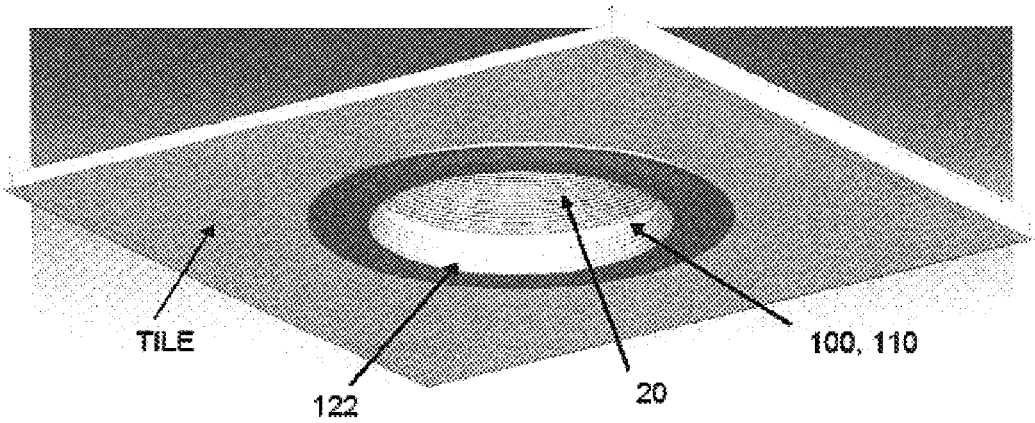
FIG. 27 is a perspective view of a twelfth embodiment of a volumetric downlight light fixture of the present invention, showing the fixture mounted therein a ceiling tile.
Figure 28:
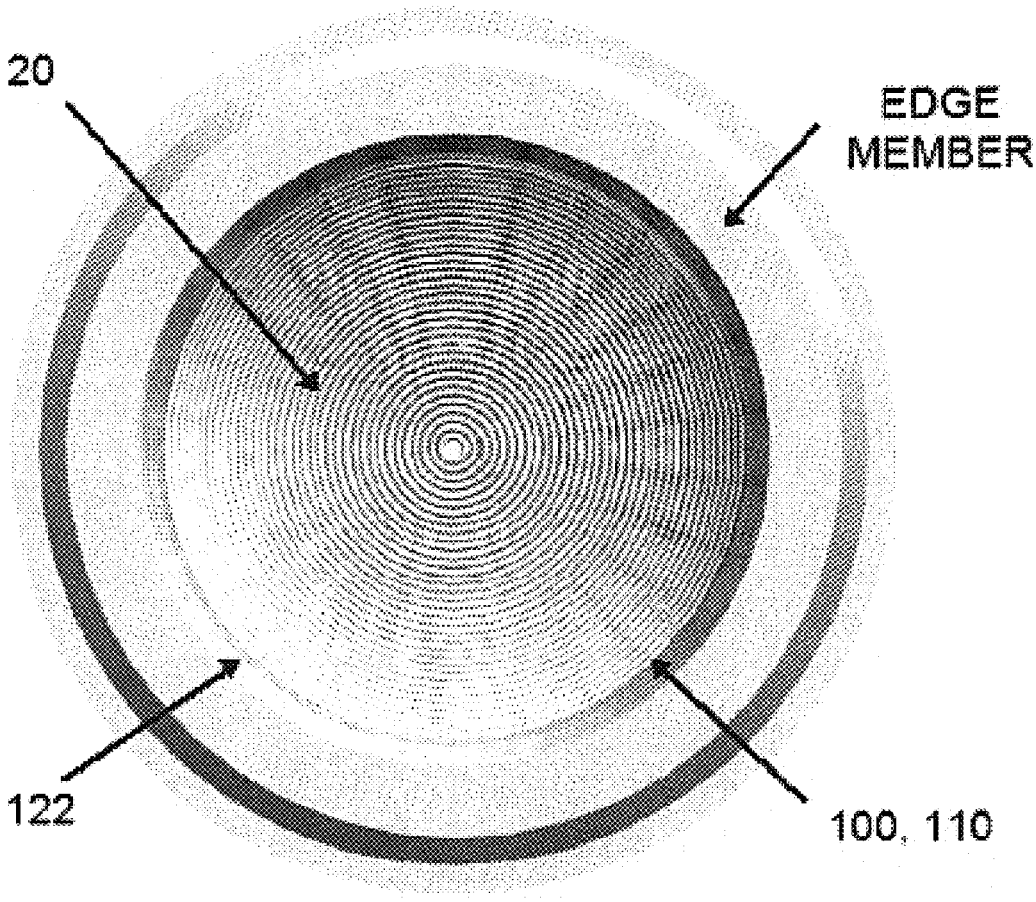
FIG. 28 is a bottom plan elevational view of the volumetric downlight light fixture of FIG. 27.
Figure 29:
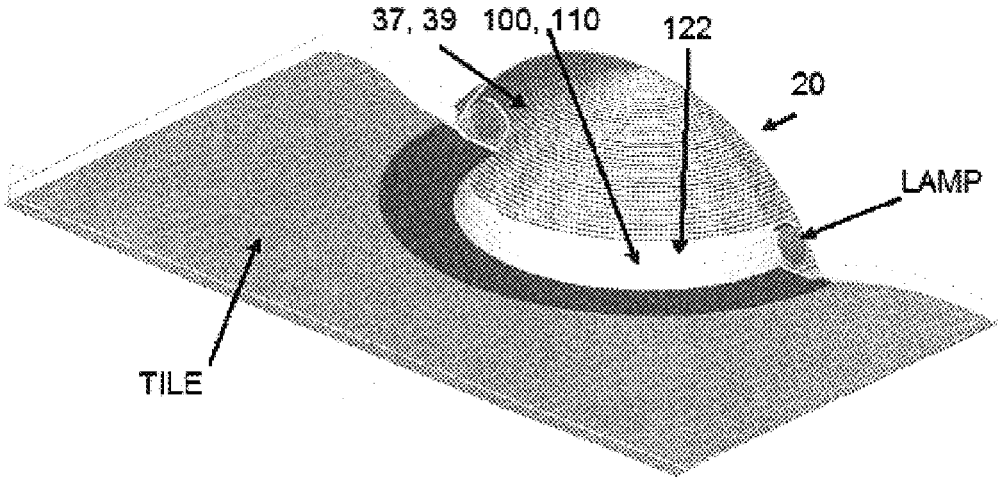
FIG. 29 is a partial broken away perspective view of the volumetric downlight light fixture of FIG. 27.

Similarly, and referring to the exemplary embodiment shown in FIGS. 27-29, in one aspect, the lens assembly 100 is positioned at the bottom plane of the light fixture and has a generally toric shape configured for operative receipt of the circular fluorescent lamp. In this aspect, the light fixture 10 has a non-opaque edge member positioned in the bottom plane and the lens extends upwardly and away from the edge member and into the interior volume of the light fixture. As shown, the reflector assembly 20 extends upwardly and around the lens assembly 110 and substantially encloses the lamp. In this aspect, the reflector assembly is generally dome shaped without a central opening. As illustrated, it is contemplated that the surface of the reflector assembly 20 can have, as desired, ridges or grooves 37, 39 as desired. In operation, light is diffused optically via the prismatic elements 122 of the lens 110 and is reflected off of the overlying reflector assembly into the desired lighting environment.

Figure 30:
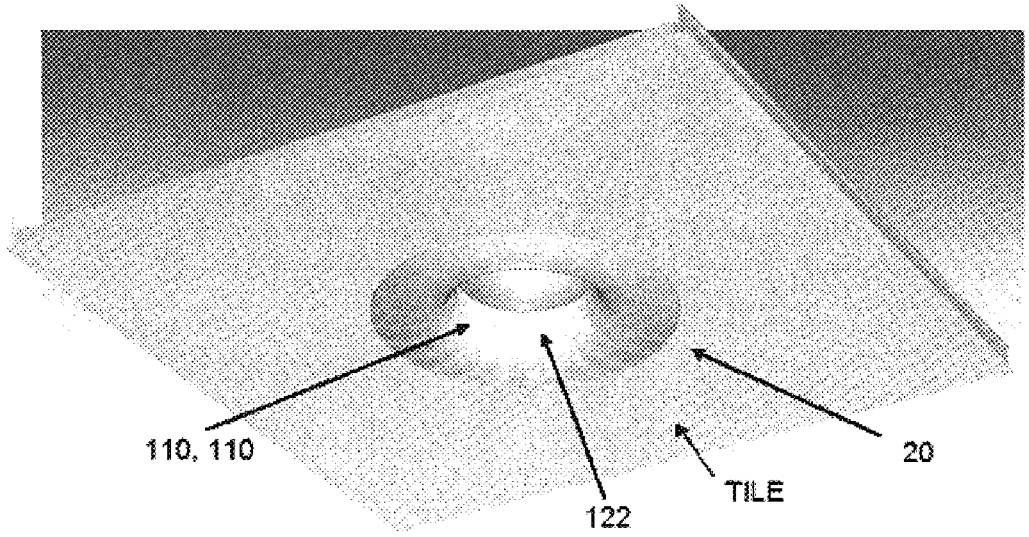
FIG. 30 is a perspective view of a thirteenth embodiment of a volumetric downlight light fixture of the present invention, showing the fixture mounted therein a ceiling tile.
Figure 31:
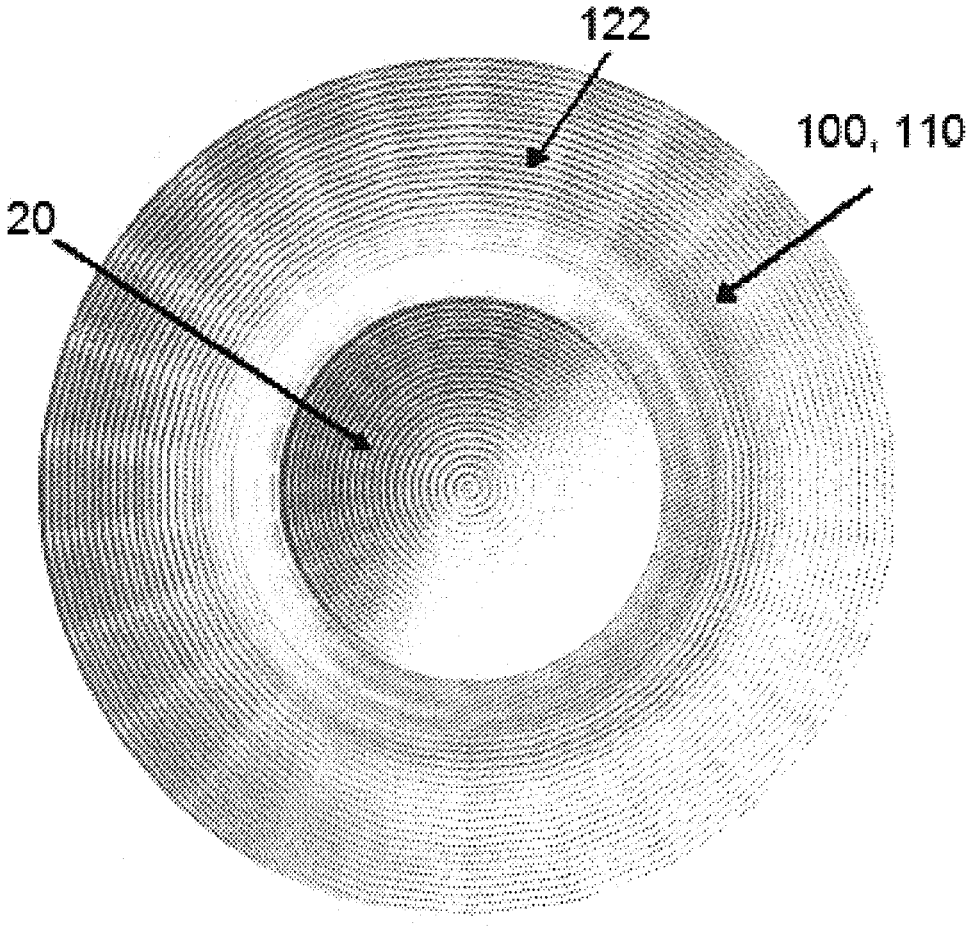
FIG. 31 is a bottom plan elevational view of the volumetric downlight light fixture of FIG. 30.
Figure 32:
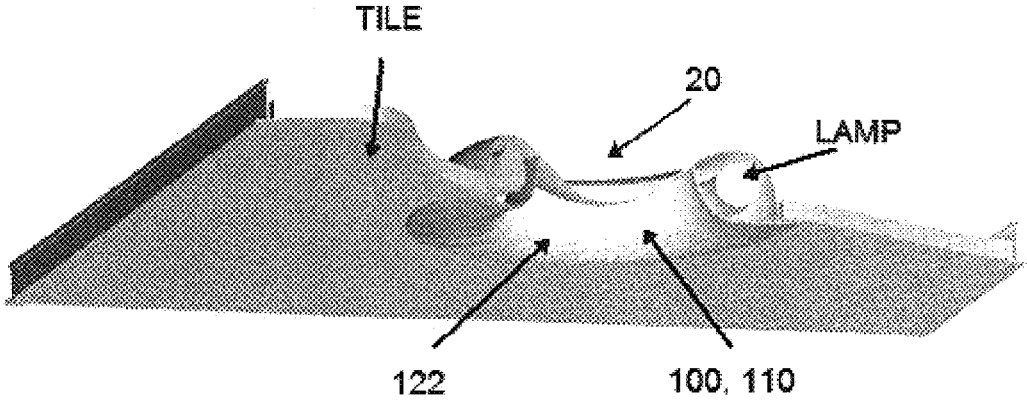
FIG. 32 is a partial broken away perspective view of the volumetric downlight light fixture of FIG. 30.
Figure 33:
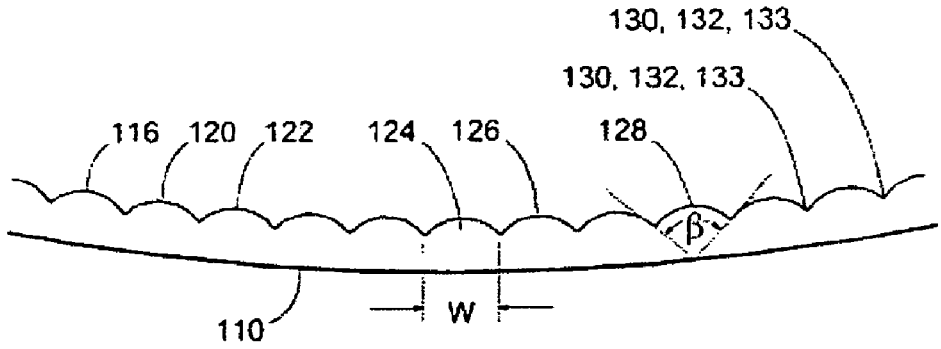
FIG. 33 is an enlarged partial sectional view of an exemplary lens assembly, showing one embodiment of an array of prismatic elements disposed on a surface of the lens.

Additionally, and referring to the exemplary embodiment shown in FIGS. 30-32, in one aspect, the lens assembly 100 is positioned at the bottom plane of the light fixture 10 and has a generally toric shape configured for operative receipt of the circular fluorescent lamp. In this example, at least a portion of the lens assembly 100 forms a visual bottom edge of the reflector. The reflector assembly 20 extends upwardly and around the lens assembly and substantially encloses the lamp. In this aspect, the center portion of the reflector assembly 20 extends downwardly toward the bottom plane of the light fixture. It is contemplated that the surface of the reflector assembly 20 can have, as desired, ridges or grooves 37, 39 as desired. In operation, light is diffused optically via the prismatic elements 122 of the lens 110 and is reflected off of the overlying reflector assembly into the desired lighting environment.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

What is claimed is:

1. A downlight fixture for directing light toward an area desired to be illuminated, comprising:

a reflector assembly comprising a base member having a bottom peripheral edge and defining an opening positioned in a central portion of the base member, wherein the bottom peripheral edge extends circumferentially substantially symmetrically about the central portion of the base member;

a light source for generating the light, the light source being mountable at least partially therein the opening of the reflector assembly; and a lens assembly selectively mountable to a recessed portion of the base member of the reflector assembly thereabout the opening of the reflector assembly, the lens assembly comprising:

a) a lens having a curved central lens portion, the central lens portion having a substantially smooth exterior surface and an opposed prismatic surface that defines a concave face spaced from and facing the light source; and b) a means for generating a plurality of spaced regions of reduced brightness to control high angle glare optically comprising a plurality of adjoining elongate prismatic elements formed on the prismatic surface of the central lens portion, wherein each prismatic element has a curved surface facing toward the light source, wherein each pair of adjoining elongate prismatic elements form a common elongate cusp edge, wherein each elongate prismatic element of the plurality of adjoining elongate prismatic elements is configured such that a reverse ray impacting the elongate prismatic element proximate the common cusp edge at an angle of incidence $\omega$ of at least about 40° will undergo total internal reflection and be reflected back into the area to be illuminated to form a region of reduced brightness on the exterior surface of the lens.

2. The downlight fixture of claim 1, wherein at least a portion of the peripheral edge of the base member is positioned in a bottom plane that is substantially coplanar with a ceiling plane; wherein the opening of the base member is positioned in a top plane that is spaced a predetermined distance from the bottom plane.

3. The downlight fixture of claim 1, wherein at least a portion of the base member forms a hollow that extends inwardly in the transverse direction away from the peripheral edge of the base member, and wherein at least a portion of the hollow comprises a reflective surface that extends generally between the central portion and the peripheral edge of the base member.

4. The downlight fixture of claim 3, wherein a least a portion of the hollow has a generally curved shape.

5. The downlight fixture of claim 3, wherein at least a portion of the hollow has a substantially linear shape.

6. The downlight fixture of claim 3, wherein at least a portion of the reflective surface of the base member has a plurality of adjacent spaced male ridges formed thereon that at least partially surround the opening of the central portion of the base member.

7. The downlight fixture of claim 6, wherein each respective male ridge extends at least partially about the opening of the central portion of the base member such that a respective male ridge that is positioned closer to the peripheral edge has a larger circumferential shape than a male ridge that is positioned closer to the opening.

8. The downlight fixture of claim 2, wherein at least a portion of the light source is positioned above the top plane of the base member.

9. The downlight fixture of claim 1, wherein the base member has a first end face and an opposed second end face, the opposed first and second end faces each being positioned with respect to the base member such that each of the respective first and second end faces has a face longitudinal axis that forms an obtuse angle of about and between 95° to 160° with respect to a longitudinal axis of the base member.

10. The downlight fixture of claim 9, wherein the lens is elongated and has a lens longitudinal axis, wherein the central lens portion is curved in a plane transverse to the lens longitudinal axis and extends generally parallel to the longitudinal axis of the base member, and wherein the plurality of adjoining prismatic elements formed on the prismatic surface of the central lens portion extend generally longitudinally parallel to the longitudinal axis of the base member such that the spaced regions of reduced brightness form stripes of reduced brightness that extend substantially parallel to the lens longitudinal axis.

11. The downlight fixture of claim 1, further comprising a means for providing geometric control of high-angle rays emanating from the lens.

12. The downlight fixture of claim 11, wherein the lens is recessed with respect to the peripheral edge of the reflector assembly such that light rays produced at high viewing angles are physically blocked by the bottom peripheral edge of the reflector assembly, and wherein the lens is mounted thereto the reflector assembly such that substantially all of the light emitted by the light source passes through the lens prior to impacting portion of a reflective surface of the reflector assembly.

13. The downlight fixture of claim 1, wherein each prismatic element has substantially the same shape.

14. A method of controlling light emitted at angles close to a ceiling plane, comprising:

mounting a downlight fixture substantially parallel to the ceiling plane, the downlight fixture comprising:

a. a reflector assembly comprising a base member having a bottom peripheral edge and defining an opening positioned in a central portion of the base member, wherein the bottom peripheral edge extends circumferentially substantially symmetrically about the central portion of the base member;

b. a light source for generating the light, the light source being mountable at least partially therein the opening of the reflector assembly; and c. a lens assembly selectively mountable to a portion of the base member of the reflector assembly thereabout the opening of the reflector assembly, the lens assembly comprising a lens having a curved central lens portion, the central lens portion having an substantially smooth exterior surface and an opposed prismatic surface that defines a concave face spaced from and facing the light source; the lens assembly further comprising a means for generating a plurality of spaced regions of reduced brightness to control high angle glare optically comprising a plurality of adjoining elongate prismatic elements formed on the prismatic surface of the central lens portion, wherein each prismatic element has a curved surface facing toward the light source, wherein each pair of adjoining elongate prismatic elements form a common elongate cusp edge, wherein each elongate prismatic element of the plurality of adjoining elongate prismatic elements is configured such that a reverse ray impacting the elongate prismatic element proximate the common cusp edge at an angle of incidence o of at least about 40° will undergo total internal reflection and be reflected back into the area to be illuminated to form a region of reduced brightness on the exterior surface of the lens, wherein the lens is recessed with respect to the peripheral edge of the reflector assembly such that light rays produced at high viewing angles are physically blocked by the bottom peripheral edge of the reflector assembly, and wherein the lens is mounted thereto the reflector assembly such that substantially all of the light emitted by the light source passes through the lens prior to impacting portion of a reflective surface of the reflector assembly.

15. The method of claim 14, wherein the lens is elongated and has a lens longitudinal axis, wherein the central lens portion is curved in a plane transverse to the lens longitudinal axis and extends generally parallel to a longitudinal axis of the base member, and wherein the plurality of adjoining prismatic elements formed on the prismatic surface of the central lens portion extend generally longitudinally parallel to the longitudinal axis of the base member such that the spaced regions of reduced brightness form stripes of reduced brightness that extend substantially parallel to the lens longitudinal axis.

16. The method of claim 15, whereby the lens assembly appears to dim at high viewing angles in a vertical plane substantially parallel to the longitudinal axis of the base member.

17. The method of claim 15, wherein the base member has a first end face and an opposed second end face, the opposed first and second end faces each being positioned with respect to the base member such that each of the respective first and second end faces has a face longitudinal axis that forms an obtuse angle of about and between 95° to 160° with respect to a longitudinal axis of the base member.

18. A downlight fixture for directing light toward an area desired to be illuminated, comprising:

a reflector assembly comprising a base member having a bottom peripheral edge extending circumferentially substantially symmetrically about a central portion of the base member;

a light source for generating the light, the light source having a generally circular shape and being mountable adjacent to the bottom peripheral edge of the reflector assembly; and a lens assembly selectively mountable to a portion of the base member of the reflector assembly adjacent to the bottom peripheral edge of the reflector assembly, the lens assembly comprising:

a) a lens having a generally toric shape configured for operative receipt of the light source, the lens having a substantially smooth exterior surface and an opposed prismatic surface that is spaced from and faces the light source; and b) a means for generating a plurality of spaced regions of reduced brightness to control high angle glare optically comprising a plurality of adjoining elongate prismatic elements formed on the prismatic surface of the central lens portion, wherein each elongate prismatic element of the plurality of adjoining elongate prismatic elements is configured such that a reverse ray impacting the elongate prismatic element proximate the common cusp edge at an angle of incidence ω of at least about 40° will undergo total internal reflection and be reflected back into the area to be illuminated to form a region of reduced brightness on the exterior surface of the lens;

wherein light emitted from the light source is diffused optically by the prismatic elements of the lens and is reflected off of the overlying reflector assembly into the desired lighting environment.

19. The light fixture of claim 18, wherein at least a portion of the lens assembly forms a visual bottom edge of the reflector assembly, wherein the reflector assembly and the lens substantially enclose the light source such that substantially all of the light emitted by the light source passes through the lens prior to impacting a portion of a reflective surface of the reflector assembly.

20. The light fixture of claim 18, wherein at least a portion of the lens assembly forms a visual bottom edge of the light fixture.

* * * * *